US010415259B2

(12) United States Patent
Jungklaus et al.

(10) Patent No.: US 10,415,259 B2
(45) Date of Patent: Sep. 17, 2019

(54) FINISHING TUBE ASSEMBLY

(71) Applicant: Axia Acquisition Corporation, Stone Mountain, GA (US)

(72) Inventors: Matthew W. Jungklaus, Lawrenceville, GA (US); Timothy Joseph Beran, Dacula, GA (US)

(73) Assignee: AXIA ACQUISITION CORPORATION, Stone Mountain, GA (US)

( * ) Notice: Subject to any disclaimer, the term of this patent is extended or adjusted under 35 U.S.C. 154(b) by 231 days.

(21) Appl. No.: 15/487,131

(22) Filed: Apr. 13, 2017

(65) Prior Publication Data

US 2017/0298640 A1 Oct. 19, 2017

Related U.S. Application Data

(60) Provisional application No. 62/321,972, filed on Apr. 13, 2016.

(51) Int. Cl.
*E04F 21/165* (2006.01)

(52) U.S. Cl.
CPC ..... *E04F 21/1652* (2013.01)

(58) Field of Classification Search
CPC ..... Y10T 156/179; Y10T 156/1798; Y10T 156/1788; B44C 7/04; B44C 7/08; E04F 21/02; E04F 21/023; E04F 21/026; E04F 21/06; E04F 21/08; E04F 21/16; E04F 21/161; E04F 21/162; E04F 21/163; E04F 21/165; E04F 21/1652; E04F 21/1657; E04F 21/24; E04F 21/241
See application file for complete search history.

(56) References Cited

U.S. PATENT DOCUMENTS 1,849,948 A 3/1932 Muchler
2,514,626 A * 7/1950 Clipson ..... E04F 21/08 15/235.4
2,571,096 A * 10/1951 Ames ..... E04F 21/165 401/263
2,666,323 A * 1/1954 Ames ..... E04F 21/165 401/48
2,824,442 A * 2/1958 Ames ..... E04F 21/06 401/171

(Continued)

OTHER PUBLICATIONS

International Search Report and Written Opinion for Application No. PCT/US17/27448 dated Aug. 16, 2017 (15 pages).

*Primary Examiner* — Patrick M. Buechner
(74) *Attorney, Agent, or Firm* — Michael Best & Friedrich LLP

(57) ABSTRACT

A finishing head for attachment to a viscous material dispense includes an adapter having an inlet attachable to the viscous material dispenser and defining a first axis, and an outlet defining a second axis perpendicular to the first axis. The finishing head further includes a finisher body having a cavity and an opening in a bottom face thereof, and a hollow pivot pivotably coupling the adapter to the finisher body about the second axis. The cavity of the finisher body is in fluid communication with the adapter outlet via the hollow pivot such that viscous material discharged from the adapter outlet passes through the hollow pivot before being discharged from the opening of the finisher body.

10 Claims, 20 Drawing Sheets

(56) References Cited

U.S. PATENT DOCUMENTS 3,319,283 A * 5/1967 Delligatti ..... E04F 21/08 401/263
3,602,405 A * 8/1971 Ames ..... E04F 21/06 222/386
3,960,643 A * 6/1976 Dargitz ..... B44C 7/04 156/390
4,516,868 A * 5/1985 Molnar ..... E04F 21/06 401/171
5,010,618 A * 4/1991 Croft ..... B05C 17/10 15/235.7
5,099,539 A * 3/1992 Forester ..... A47L 1/06 15/144.3
5,902,451 A 5/1999 O'Mara et al.
6,874,965 B1 * 4/2005 Mondloch ..... E04F 21/08 15/235.3
7,806,613 B2 10/2010 Mondloch et al.
9,283,586 B2 3/2016 MacMillan
9,889,464 B1 * 2/2018 Winne ..... B05C 17/00
2001/0003563 A1 6/2001 Schauer et al.
2001/0053419 A1 12/2001 Ruha et al.
2003/0221774 A1 * 12/2003 Fishburn ..... B29C 63/0047 156/285
2005/0100386 A1 * 5/2005 Murray ..... B05C 17/005 401/5
2005/0120512 A1 6/2005 Choi
2007/0077114 A1 * 4/2007 Mondloch ..... E04F 21/08 401/48
2009/0041536 A1 * 2/2009 Cole ..... E04F 21/00 403/122
2011/0297327 A1 * 12/2011 Castagnetta ..... B25G 3/38 156/575
2013/0216294 A1 * 8/2013 MacMillan ..... B05C 17/01 401/143
2013/0279967 A1 * 10/2013 Otto ..... B05C 17/00516 401/265
2016/0312479 A1 * 10/2016 Jungklaus ..... E04F 21/165
2017/0100740 A1 * 4/2017 Pentland ..... B05C 17/01

* cited by examiner

FINISHING TUBE ASSEMBLY

CROSS-REFERENCE TO RELATED APPLICATIONS

This application claims priority to U.S. Provisional Patent Application No. 62/321,972 filed on Apr. 13, 2016, the entire content of which is incorporated herein by reference.

BACKGROUND

The present disclosure relates to a tube for drywall or other types of finishing compound.

SUMMARY

In one embodiment, the disclosure provides a finishing head for attachment to a viscous material dispenser. The finishing head includes an adapter having an inlet attachable to the viscous material dispenser and defining a first axis, and an outlet defining a second axis perpendicular to the first axis. The finishing head further includes a finisher body having a cavity and an opening in a bottom face thereof, and a hollow pivot pivotably coupling the adapter to the finisher body about the second axis. The cavity of the finisher body is in fluid communication with the adapter outlet via the hollow pivot such that viscous material discharged from the adapter outlet passes through the hollow pivot before being discharged from the opening of the finisher body.

In another embodiment, the disclosure provides a finishing assembly for dispensing a viscous material. The finishing assembly includes a dispenser in which the viscous material is storable and a finishing head removably coupled to the dispenser to receive viscous material therefrom. The finishing head includes an opening in a bottom face thereof through which the viscous material is discharged and a blade proximate the opening to spread the discharged viscous material across a width of the finishing head.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
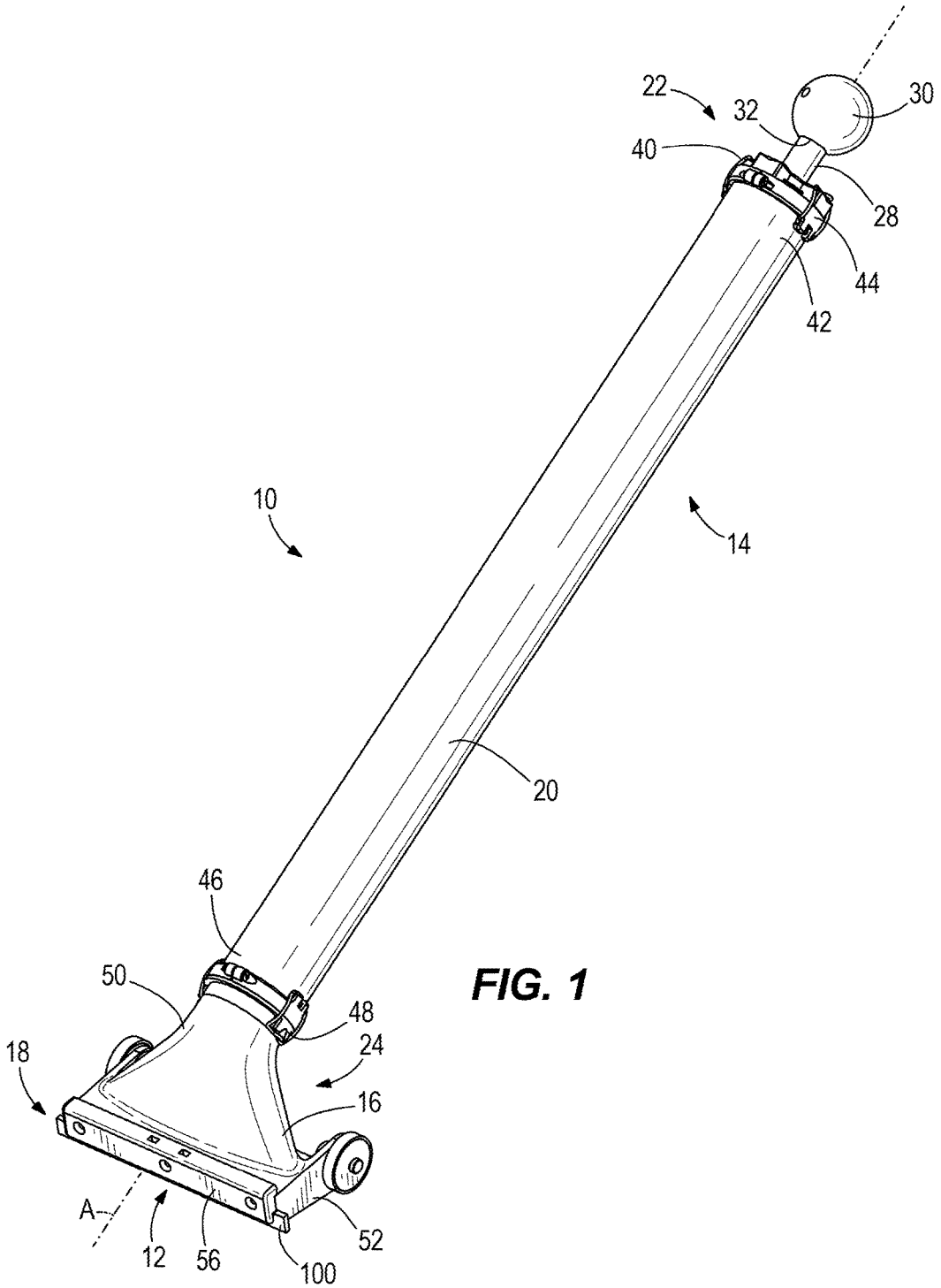
FIG. 1 illustrates a perspective view of a finishing tube assembly according to a first embodiment.

FIG. 1 illustrates a finishing head 12 and a dispenser or compound tube 14, which, when combined, are referred to as a finishing tube assembly 10. The finishing head 12 includes a head body 16 and a blade assembly 18, described further hereafter. The compound tube 14 includes a tube body 20, a plunger 22, and a head attachment assembly 24, also described further hereafter. For the purposes of this application, the finishing tube assembly 10 is preferably for drywall finishing on a joint between pieces of drywall. Drywall finishing is described herein as an example application, but the finishing tube assembly 10 may also be applied to other various types of joints or seams that need to be sealed or finished. The finishing tube assembly 10 may apply material other than drywall compound to almost any surface, not limited to joints, such as fiber reinforced plastic sheeting or tiling. Furthermore, the finishing tube assembly 10 may be used with an appropriately shaped blade to leave an adhesive on wallboard, so the operator can place fiber reinforced plastic sheet on the wall board (e.g., to waterproof bathroom walls).

Figure 2:
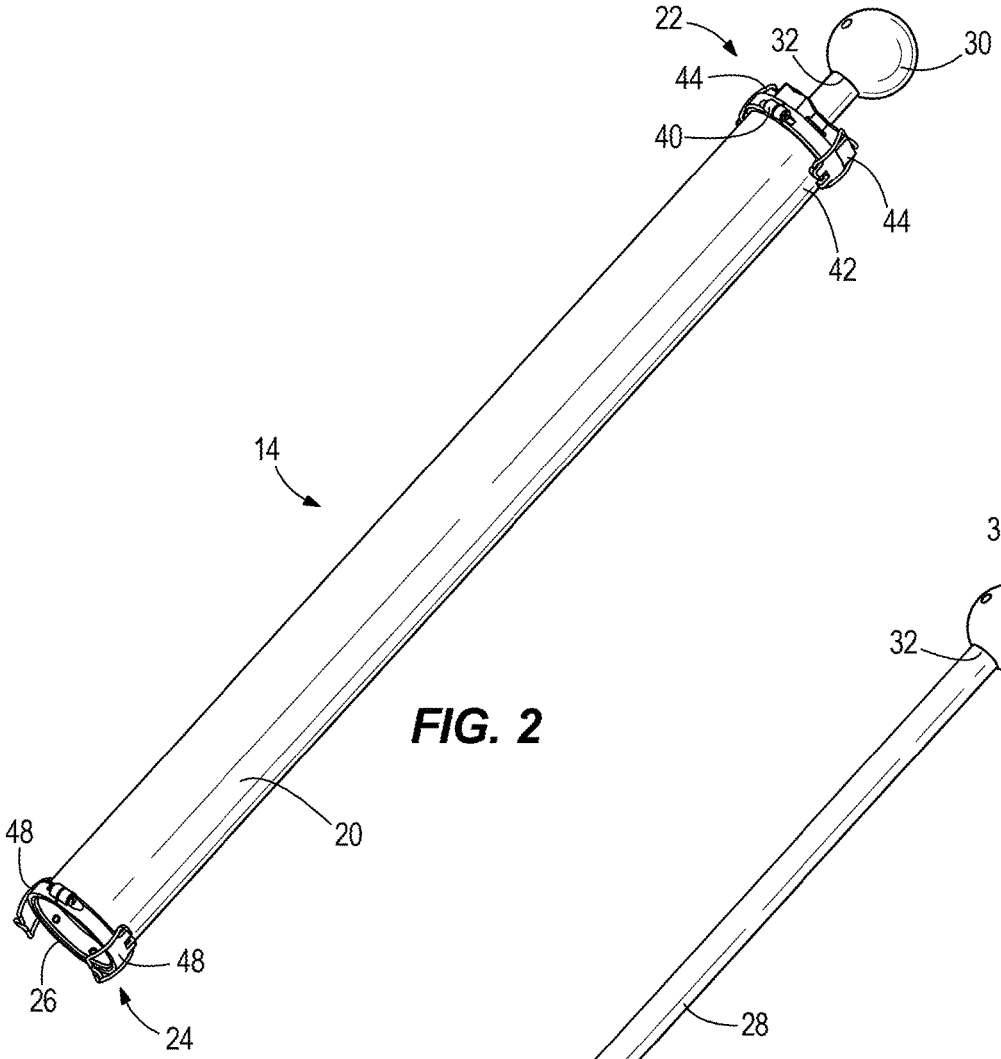
FIG. 2 illustrates a perspective view of a compound tube of the finishing tube assembly of FIG. 1.
Figure 3:
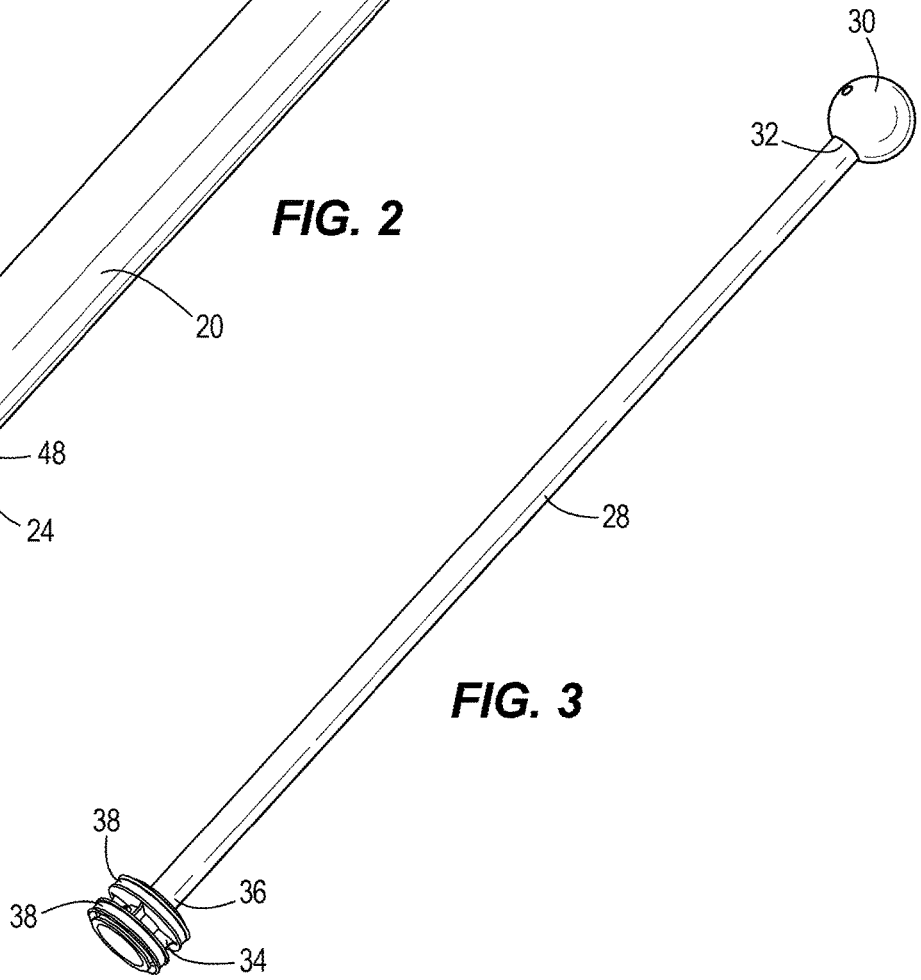
FIG. 3 illustrates a perspective view of a plunger of the compound tube of FIG. 2.

FIGS. 1-3 illustrate the compound tube 14 for the finishing tube assembly 10, including the tube body 20, the plunger 22, and the head attachment assembly 24. In the embodiment illustrated in FIGS. 1 and 2, the tube body 20 is a cylinder that has a constant diameter throughout its longitudinal length. The tube body 20 defines a longitudinal axis A. The tube body 20 may have a polygonal cross-section in other embodiments. The interior of the tube body 20 defines a cavity 26 that is configured to store joint compound. Illustrated in FIG. 3, the plunger 22 includes a pole 28, a grip 30 at a first end 32 of the pole 28, and a double-banded plug 34 at a second end 36 of the pole 28. In the embodiment illustrated in FIGS. 1-3, the grip 30 is spherical and configured to be grasped and pushed by an operator, as explained in greater detail below. In other embodiments, the grip 30 may be a handle (not illustrated) having finger slots or may be generally shaped to be gripped comfortably. The double-banded plug 34 includes two rubber seals 38 that are shaped to snugly fit within the inner diameter of the tube body 20 so that the double-banded plug 34 is able to efficiently push finishing compound out of the tube body 20, as explained in greater detail below. The compound tube 14 includes a cap 40 positioned at a first end 42 of the tube body 20. The cap 40 is coupled to the tube body 20 by a pair of clips 44, as illustrated in FIG. 2. The center of the cap 40 includes a cylindrical opening (not illustrated) that is shaped so that it is slightly larger than the diameter of the pole 28 of the plunger 22, enabling the pole 28 to slide within the cylindrical opening. Accordingly, the plunger 22 is centered in the tube body 20 by the relationship between the plug 34 and tube body 20 as well as by the pole 28 and the cap 40 such that a longitudinal axis of the pole 28 is aligned with the first axis A. The head attachment assembly 24 is positioned at a second end 46 of the tube body 20 and includes a pair of clips 48 that are spaced 180 degrees from each other. The head attachment assembly 24 is configured to couple the compound tube 14 and the finishing head 12, as explained in greater detail below.

Figure 4:
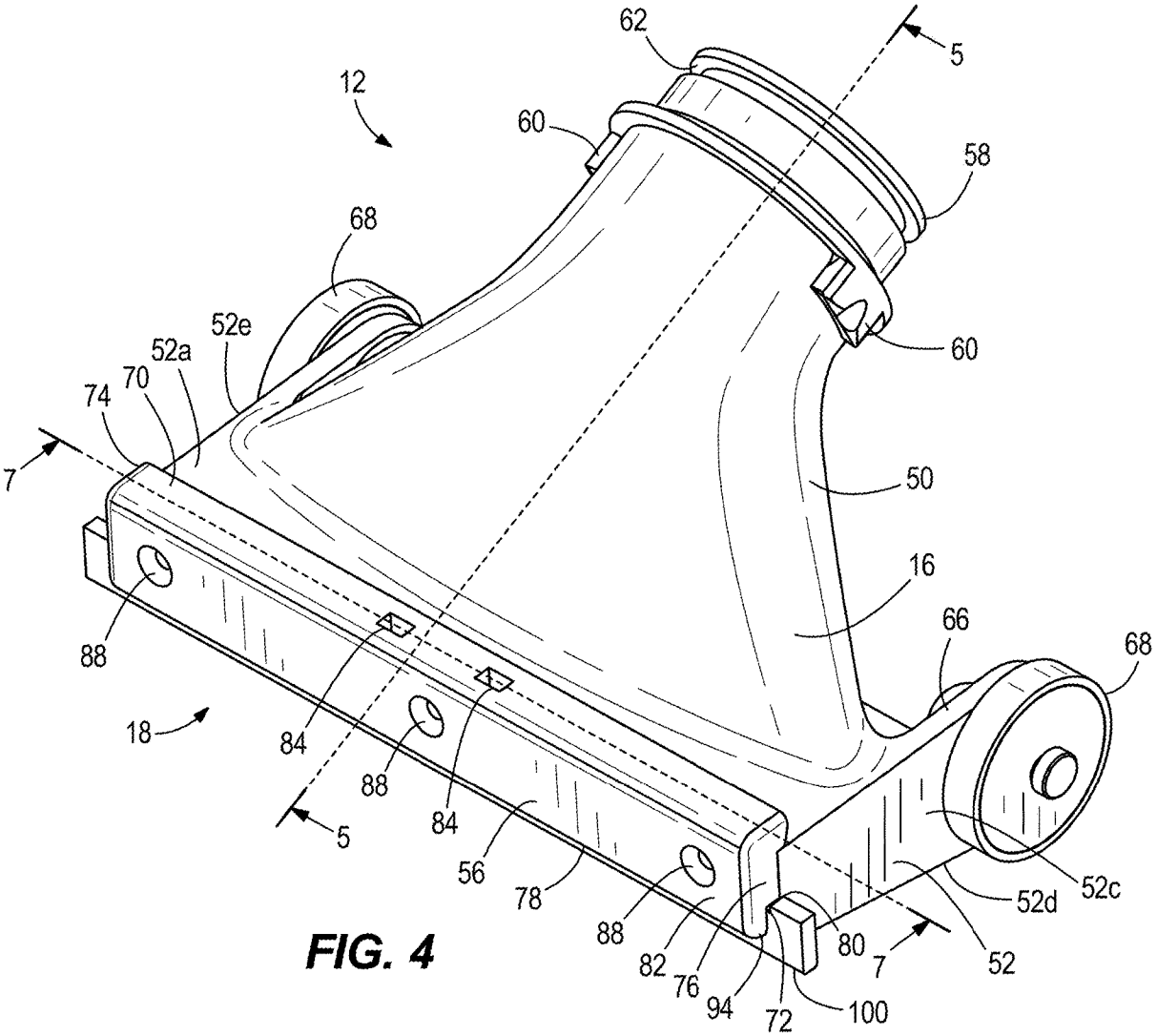
FIG. 4 illustrates a perspective view of a finishing head of the finishing tube assembly of FIG. 1.
Figure 5:
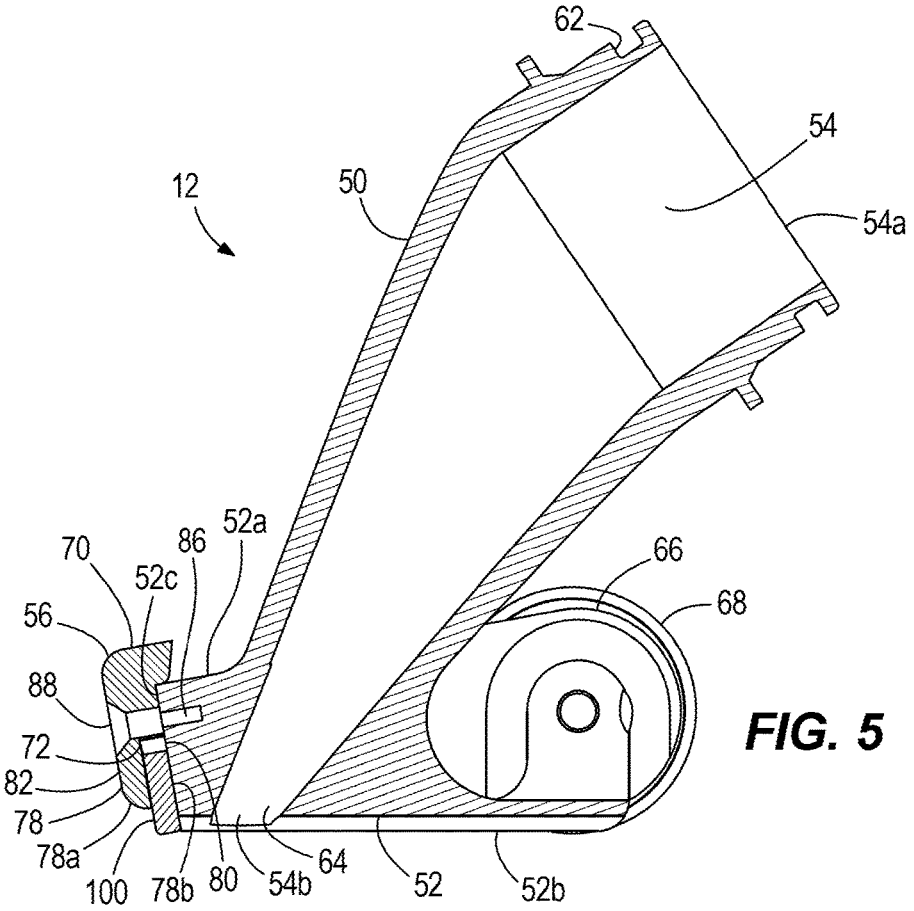
FIG. 5 illustrates a sectional view of the finishing head of FIG. 4 taken along lines 5-5.

FIGS. 1 and 4-6 illustrate the finishing head 12 according to a first embodiment, including the head body 16 and the blade assembly 18. The head body 16 includes a cone portion 50 and a block portion 52 that is integrally formed with the cone portion 50. As illustrated in FIG. 5, a channel 54 extends through the head body 16 of the finishing head 12. The blade assembly 18 is coupled to the head body 16 of the finishing head 12 and includes a blade holder 56 and a blade 100.

Figure 6:
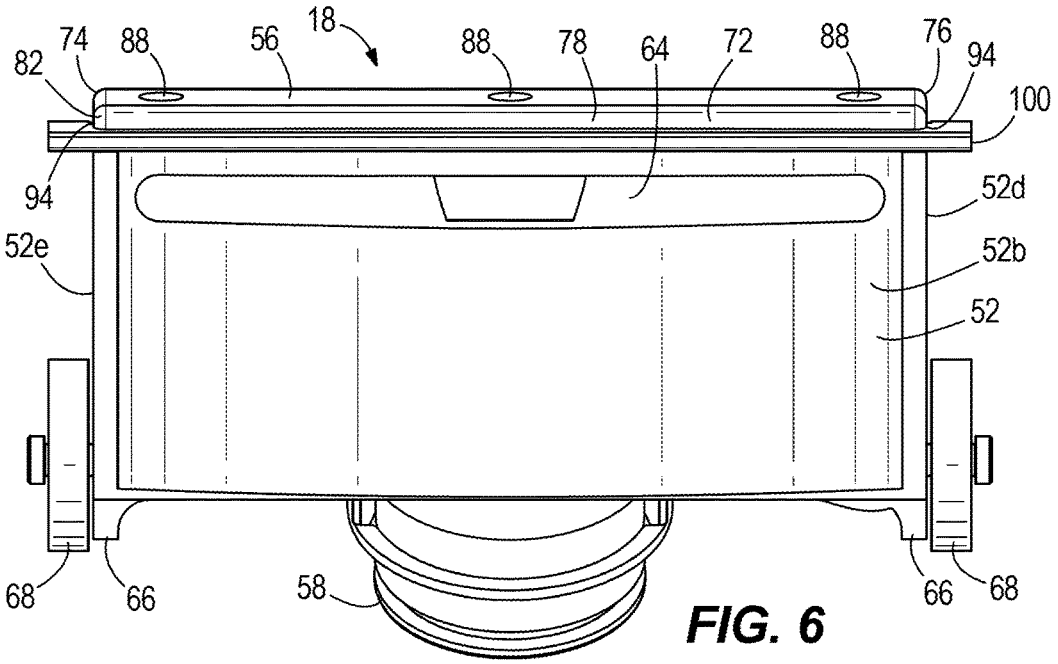
FIG. 6 illustrates a bottom view of the finishing head of FIG. 4.

As illustrated in FIGS. 4 and 5, the cone portion 50 of the body includes a cylindrical mating portion 58 that is configured to couple to the compound tube 14 such that finishing compound is capable of flowing from the cavity 26 of the tube body 20 to the channel 54 of the finishing head 12. The cylindrical mating portion 58 has two extensions 60 configured to couple to the pair of clips 48 of the head attachment assembly 24. An O-ring (not illustrated) may be positioned about a seat 62 on the cylindrical mating portion 58 to provide a liquid-tight seal between the finishing head 12 and the compound tube 14 when they are coupled. As illustrated in FIG. 4, the head body 16 widens throughout the cone portion 50 until the cone portion 50 reaches the block portion 52. The block portion 52 includes a top face 52*a*, a bottom face 52*b* opposing the top face 52*a*, a front face 52*c*, and two side faces 52*d*, 52*e* that oppose each other. The cone portion 50 extends from the top face 52*a* of the block portion 52. The blade assembly 18 is coupled to the front face 52*c* of the block portion 52, as described in greater detail below. As illustrated in FIG. 6, the bottom face 52*b* of the block portion 52 includes an opening 64 that communicates with the channel 54. The block portion 52 includes two extensions 66, one extending from each side face 52*d*, 52*e*, that project in a direction nearly perpendicular to the front face 52*c*, as shown in FIG. 5. A wheel 68 is positioned on each of the extensions 66. In other embodiments, a skid or skids (not illustrated) may be positioned at the end of each extension 66 in place of one or both of the wheels 68. In the embodiment illustrated in FIGS. 4 and 5, the cone portion 50 generally extends from the block portion 52 at an angle of 34 degrees. In other embodiments, the cone portion 50 may extend from the block portion 52 at any angle between 10 and 80 degrees.

The head body 16 of the finishing head 12 may be made from a plurality of different materials and constructed by a variety of methods. In the illustrated embodiment, the head body 16 is molded from a plastic, such as polypropylene (PP), polyvinyl chloride (PVC), polyethylene (PE), among others, so as to be lightweight, to minimize areas on the head body 16 that are difficult to clean, and to include some non-stick properties so that joint compound does not easily clog the channel 54 of the head body 16. In other embodiments, the cone portion 50 and the block portion 52 may be molded independently and then coupled together in an assembly step to form the head body 16. In other embodiments, the head body 16 may be made from a metal.

The channel 54 of the finishing head 12 extends from the cylindrical mating portion 58 to the opening 64 of the block portion 52. As illustrated in FIGS. 4-6, a cross section of the channel 54 changes shape along the length of the cone portion 50 of the head body 16. At an entrance 54*a* of the channel 54, i.e., at the cylindrical mating portion 58, the cross section of the channel 54 is cylindrical. Along the length of the cone portion 50, the cross section of the channel 54 widens in one direction and narrows in a second direction. The cross section of the channel 54 changes so that at an end 54*b* of the channel 54, i.e., at the bottom face 52*b* of the block portion 52, the cross section of the channel 54 is much wider than the entrance 54*a* of the channel, but the overall cross sectional area of the channel 54 at the end 54*b* is similar to the area at the entrance 54*a* of the channel 54. In some embodiments, the cross section al area of the channel 54 at the end 54*b* is equal to the cross sectional area at the entrance 54*a* of the channel 54. In other embodiments, the cross sectional area of the channel 54 at the end 54*b* of the channel 54 may be smaller or larger than the cross sectional area of the channel 54 at the entrance 54*a* of the channel 54.

The finishing head 12 is attached to the compound tube 14 such that a continuous flow path is formed from the cavity 26 of the tube body 20 to the opening 64 of the head body 16. In the embodiment illustrated in FIG. 1, the pair of clips 48 of the head attachment assembly 24 on the compound tube 14 are coupled to the extensions 60 of the head body 16 of the finishing head 12. In other embodiments, the compound tube 14 and the finishing head 12 may be coupled to each other in other ways. In yet other embodiments, the tube assembly and the finishing head 12 may be integrally formed.

FIGS. 1 and 4-8 illustrate the blade assembly 18 for the finishing head 12, including the blade holder 56 and the interchangeable blade 100. The blade holder 56 has a top wall 70, a bottom wall 72 opposing the top wall 70, a first end wall 74, an opposing second end wall 76, and a front wall 78. The front wall 78 includes a front face 78*a* and an opposite rear face 78*b*, which together with the front face 52*c* of the block portion 52 defines a blade slot 80. The blade holder 56 is attachable to the front face 52*c* of the block portion 52 of the finishing head 12 and projects from the finishing head 12, and in particular from the front face 52*c* of the block portion 52 in a direction perpendicular to a plane defined by the front face 52*c*, so that the blade holder 56 is outside a footprint of the bottom face 52*b* of the block portion 52. Blade holder 56 defines the blade slot 80 for the blade 100. The blade slot 80 is formed between the rear face 78*b* of the front wall 78, the front face 52*c* of the head body 16, and the bottom wall 72, with the bottom of the blade slot

80 open for insertion of the removable blade 100. The blade holder 56 includes one or more cleaning slots 84 which extend from the top wall 70 of the blade holder 56 to the bottom wall 72 of the blade holder 56. The cleaning slots 84 extend into the blade slot 80 and provide easy access to clean the blade slot 80 without having to remove the blade holder 56 from the finishing head 12.

As best shown in FIG. 5, a portion of the front wall 78 forms an overhang 82 that extends vertically (as shown in FIG. 5) beyond the bottom wall 72 of the blade holder 56, creating a staircase shape in cross section, with the overhang 82 as a "riser" and the bottom wall 72 as a "step." The overhang 82 projects laterally (as shown in FIG. 5) from the front face 52*c* and extends from the first end wall 74 of the blade holder 56 to the second end wall 76 of the blade holder 56. In other embodiments, the overhang 82 may not extend the entire length of the blade holder 56. For example, the blade holder 56 may include multiple overhangs 82 positioned at the end walls 74, 76 of the blade holder 56 or multiple overhangs 82 positioned at the end walls 74, 76 and at the center of the blade holder 56.

The block portion 52 of the head body 16 also includes fastener openings 86 for coupling the blade holder 56 to the head body 16. In the illustrated embodiment, the blade holder 56 is coupled to the head body 16 via three fasteners (not illustrated). A first fastener extends through a fastener opening 88 of the blade holder 56 through the front wall 78 near the first end wall 74 of the blade holder 56. A second fastener extends through a fastener opening 86 of the blade holder 56 through the center of the front wall 78 of the blade holder 56. Finally, a third fastener extends through a fastener opening 86 of the blade holder 56 through the front wall 78 near the second end wall 76 of the blade holder 56. In other embodiments, any suitable number of fasteners and fastener openings may be used for the blade holder 56 and the head body 16. In yet other embodiments, the blade holder 56 may be integrally formed as one piece with the head body 16 so the blade holder 56 and the head body 16 are all one-piece.

Figure 7:
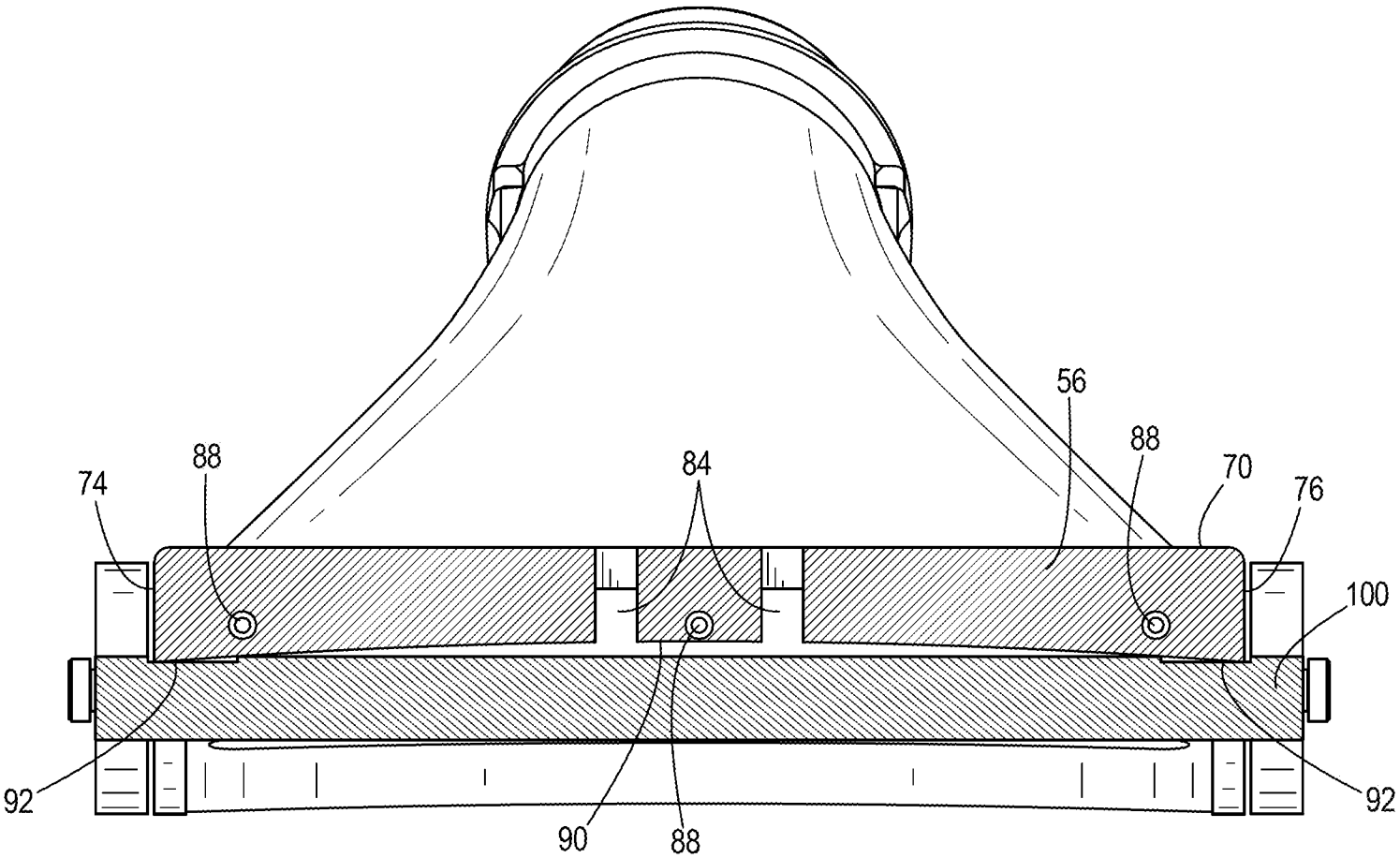
FIG. 7 illustrates a sectional view of the finishing head of FIG. 4 taken along lines 7-7.

As previously described and shown in FIG. 5, the blade slot 80 extends between the overhang 82 of the blade holder 56 and the front face 52*c* of the block portion 52. The blade slot 80 also extends from one side face 52*d* to the opposite side face 52*e* and is open below the first and the second end walls 74, 76 of the blade holder 56 (i.e., a blade 100 received in blade slot 80 may extend beyond the first and the second end walls 74, 76 of the blade holder 56). As shown in FIG. 7, the bottom wall 72 of the blade holder 56 may include a curved portion 90 to provide clearance between the blade 100 and the bottom wall 72 of the blade holder 56, allowing the blade 100 to bend or flex where the curved portion 90 permits in a direction perpendicular to the plane of the front face 52*c* (i.e., vertically as shown in FIG. 7). The curved portion 90 extends a substantial, but not the entire, length of the blade holder 56, as illustrated in the embodiment of FIG. 4. There are non-curved portions 92 adjacent each of the first and second end walls 74, 76 of the blade holder 56 in the embodiment illustrated in FIG. 7. In other embodiments, the curved portion 90 may extend shorter or longer than the illustrated embodiment. In the illustrated embodiment, the curved portion 90 of the blade slot 80 is a uniform curved shape. However, in other embodiments, the curved portion 90 may be shaped and dimensioned in a non-uniform manner (e.g., flat or angled) to provide room for the blade 100 to bend at various places along its length. In yet other embodiments, the blade holder 56 does not include a curved portion 90 and the blade slot 80 is flat for its entire length, restricting the blade 100 from bending. In some embodiments, the blade holder 56 may be fully closed near one or both end walls 74, 76 (i.e., there may be side walls (not illustrated) extending from the overhang 82 to the front face 52*c* near each end wall 74, 76 of the blade holder 56) to better capture the blade 100 within the blade slot 80.

FIGS. 9A-9D show a plurality of blades 100 for the finishing head 12. Blade design depends on the composition of the compound or other material to be expelled from the cavity in the head body 16, the surface upon which the material will be deposited, and the operator's preferences, among other things. Thus, the ability of the blade holder 56 to accommodate various blade shapes is helpful. Each blade 100 may include a blade body 102 with two niches 104 on a generally flat upper edge 106 of the blade 100. Some blades 100 (e.g., the blade 100 shown in FIG. 9A) may include a generally flat bottom edge 108, while other blades 100 (e.g., the blades 100 shown in FIGS. 9C and 9D) may include a substantially curved bottom edge 108 with a curve 110. A height of the blade 100 is defined between the upper edge 106 and the bottom edge 108. The blades 100 may include radiused or sharp (e.g., cornered) edges. The blades 100 are also preferably sufficiently thick in cross section to avoid breaking and quickly wearing down, but may have varying degrees of thickness. Other blades 100 may include a bottom edge 108 of varying degrees of curvature where the curve 110 may be along the bottom edge 108 at different places than those of the illustrated blades 100. Yet other blades 100 (e.g., the blade 100 shown in FIG. 9B) may include a plurality of curves 110. There are many other blades 100 and blade designs not illustrated herein that are capable of being used with the finishing head 12.

In one example, the blade 100 illustrated in FIGS. 1 and 4-7 includes flat portions 112 extending from each end 114, 116 of the blade 100 about ½ inch and the curve 110 in a middle section 118 of the blade 100. However, as stated above, that flat portion 112 may extend shorter or farther than ½ inch and the curve 110 may extend closer to or further from the upper edge 106 of the blade 100. The blades 100 may have radiused edges, among other things. The blades 100 may be produced in a variety of materials and in a variety of cross sections. However, preferably, the blades 100 are produced from a type of plastic so they may be easily mass produced. Furthermore, the blades 100 may be color coded to help identify which blade 100 to use at a particular time, or just for general identification purposes. Various materials and cross sections of the blade 100 can be selected as needed. While a completely rigid blade 100 will work well in many situations, it is beneficial for the blade 100 to be just flexible enough to flex over imperfections on a wall or other application surfaces without having to lift the ends 114, 116 of the blade 100 off the wall. In some embodiments, the blade 100 is rigid enough to hold the intended shape, but is flexible enough so that the ends 114, 116 of the blade 100 will remain in contact with the wall while the middle section 118 flexes over any imperfections on the wall surface.

Figure 8:
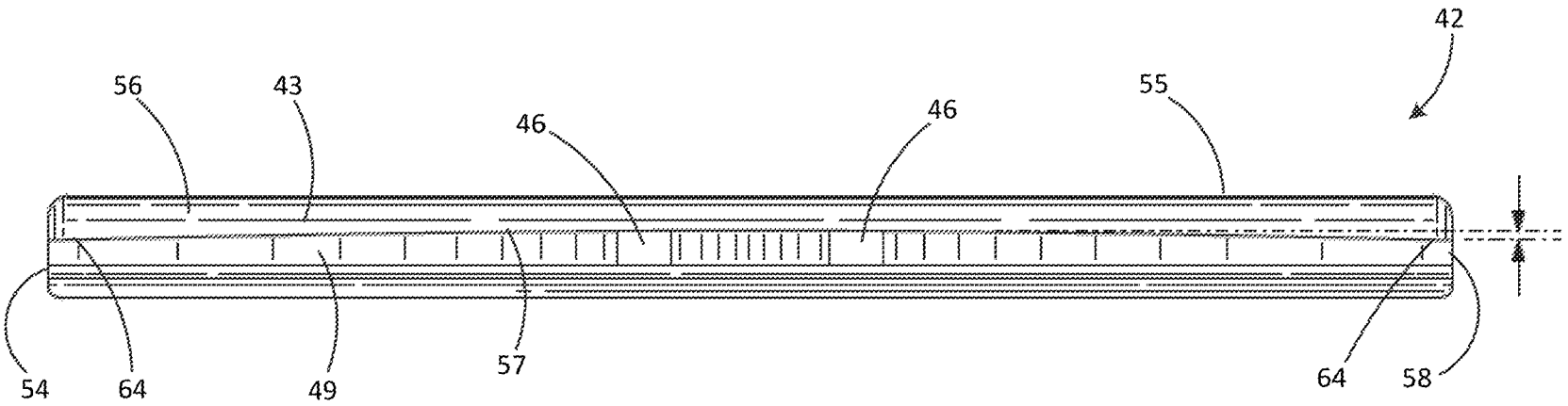
FIG. 8 illustrates a bottom view of a blade holder of the finishing head of FIG. 4.
Figures 9A, 9B, 9C, 9D:
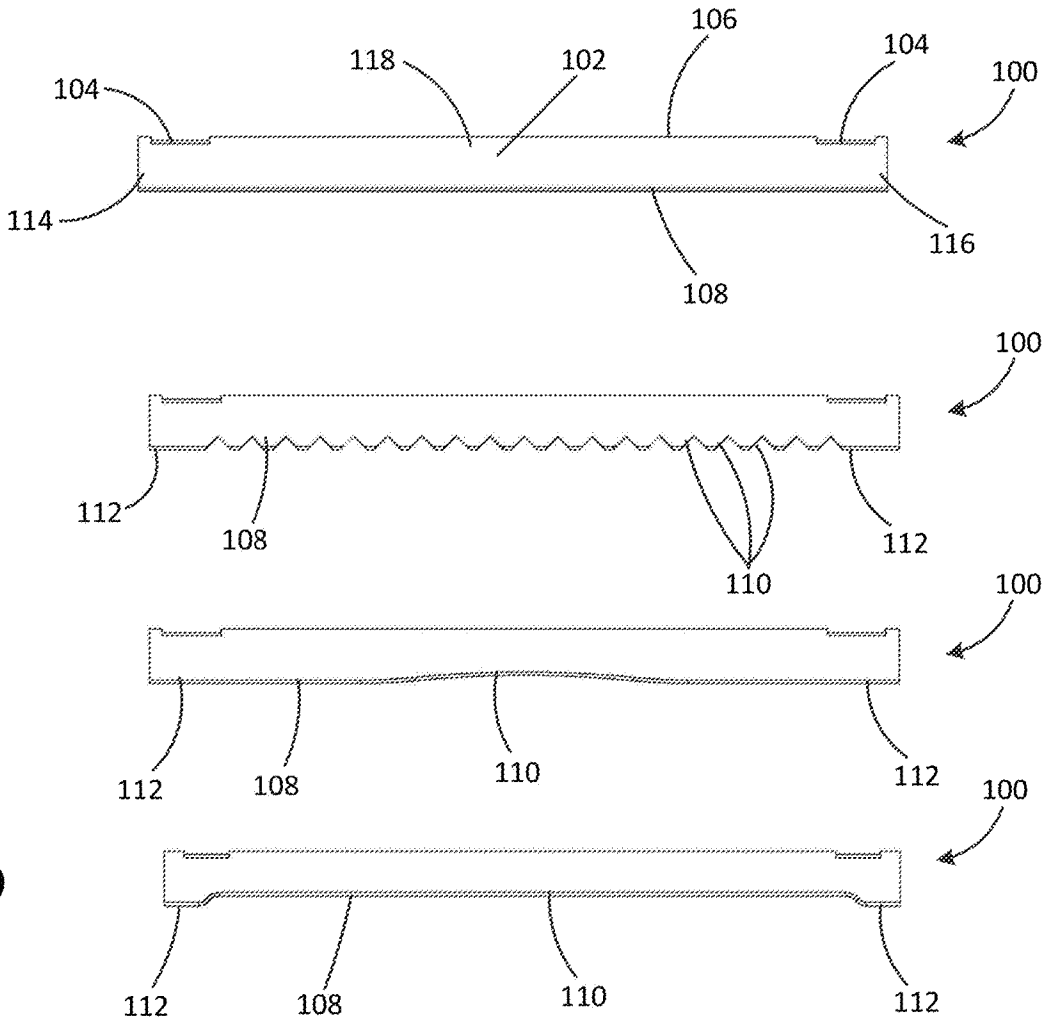
FIGS. 9A-9D illustrate a plurality of blades for the blade assembly of the finishing tube assembly of FIG. 1.
Figure 10:
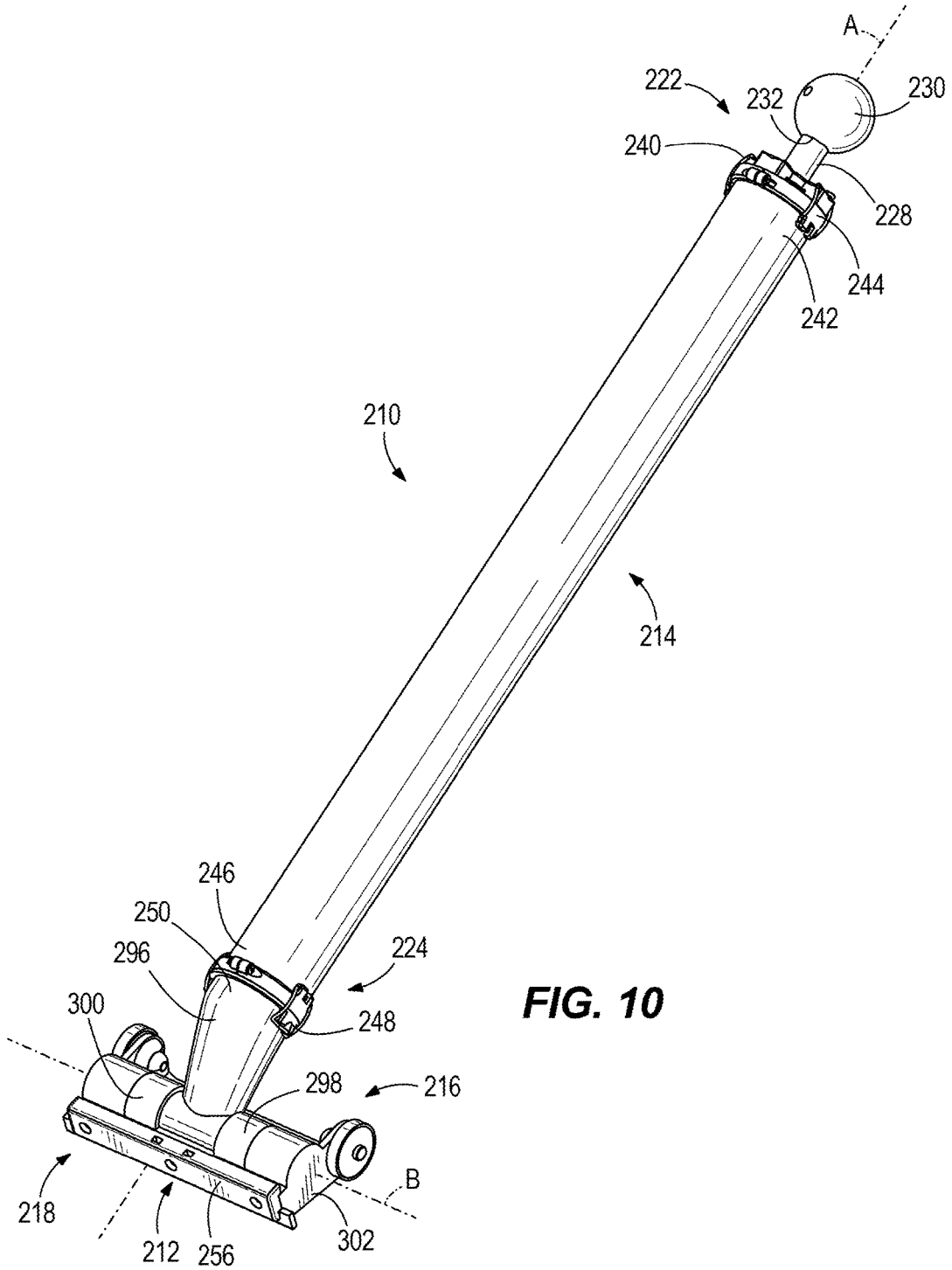
FIG. 10 illustrates a perspective view of a finishing tube assembly according to a second embodiment.

When assembled with the blade holder 56, the blade 100 extends into the blade slot 80 where the blade 100 is retained by pinch points 94 (FIGS. 6 and 8) between the overhang 82 of the blade holder 56 and the head body 16. The pinch points 94 are formed by reducing the distance between the overhang 82 and the front face 52*c* of the head body 16 to create frictional engagement of the blade 100 within the blade slot 80. One pinch point 94 is near the first end wall 74 of the blade holder 56 and another pinch point 94 is near the second end wall 76 of the blade holder 56. As illustrated in FIG. 8, the rear face 78*b* of the front wall 78 is not parallel with the front face 78*a* of the front wall 78. In other words, the thickness of the overhang 82 is not uniform along the length of the overhang 82. The overhang 82 is shaped so that the ends of the front wall 78 are closer to the front face 52*c* of the head body 16. Because the pinch points 94 are also near ends 114, 116 of the blade 100 and the blade holder 56, the blade 100 may flex upward where the blade slot 80 provides clearance until the blade 100 contacts the bottom wall 72 of the blade holder 56. The niches 104 of the blade 100 fit around the end walls 74, 76 of the blade holder 56 so that the blade 100 does not laterally slide within the blade slot 80, specifically in the directions parallel to pivot axis A. In the illustrated embodiment, the blades 100 extend slightly beyond the end walls 74, 76 of the blade holder 56.

In other embodiments, the front face 52*c* of the block portion 52 of the head body 16 may be curved and the overhang 82 may be shaped so that the rear face 78*b* and the front face 78*a* are parallel along the length of the overhang 82. In yet other embodiments, the front face 52*c* may be shaped as described above (i.e., substantially flat) and the rear face 78*b* and the front face 78*a* may be parallel along the length of the overhang 82. In this embodiment, the blade 100 may be wider at the ends 114, 116 so the blade 100 itself is shaped to provide frictional engagement between the head body 16 and the blade 100. Alternatively, the blade 100 may have a uniform width along its length, but may be wide enough so that the blade 100 is frictionally engaged along the entire length of the blade slot 80. In other words, the blade slot 80 has one pinch point 94 that extends the entire length of the blade slot 80. The blade 100 may be coupled to the head body 16 in other ways, such as by fastening the blade 100 to the head body 16 with Velcro, magnets, or fasteners.

The blade 100 is easily inserted into the blade slot 80 by placing the blade 100 along the front face 52*c* of the block portion 52 and manually pushing gently on one end 114, 116 of the blade 100 and then pushing gently on the other end 114, 116 of the blade 100. Once the blade 100 is sufficiently inserted into the blade slot 80, the pinch points 94 between the overhang 82 and the head body 16 hold the blade ends 114, 116 in place. Because the blades 100 extend beyond the end walls 74, 76 of the blade holder 56, the blade 100 is also easily removable and replaceable. The blade 100 is removable in a reverse action as that described above. The blade 100 is pushed gently on one end 114, 116 to exceed the holding force provided by the pinch point 94 so the blade 100 is at least partially removed from the blade slot 80. The operator can then grab the blade 100 and remove it completely by pulling the blade 100 from the blade slot 80. Or, the operator can push the other end 114, 116 of the blade 100 from the blade slot 80.

The ease of insertion and removal of one blade 100 allows the operator to switch between blades 100 very efficiently and quickly. By being able to quickly switch between blades 100, the operator may be able to quickly switch between projects by changing to a blade 100 of a different shape. For example, if a different crown or shape for the applied compound is desired, the operator simply replaces the current blade 100 with another blade 100 that will give the operator the desired result. There is no need to include, in the finishing head 12, a complex mechanism for manipulating the blade's shape or configuration, and that saves cost and weight that may tire the operator. The variability of the shapes of the blades 100 allows for the finishing tube assembly 10 to be used for a variety of different projects, as described above.

In operation, the blade 100 is inserted into the finishing head 12 before or after the cavity 26 of the tube body 20 is filled with a joint compound. The cavity 26 is filled with joint compound by inserting the opening 64 on the bottom face 52*b* of the block portion 52 and drawing back on the grip 30 of the plunger 22 (i.e., away from the finishing head 12). The double-banded plug 34 will follow the grip 30 and slide from the second end 46 of the tube body 20 toward the first end 42 of the tube body 20 and therefore draws joint compound through the channel 54 of the head body 16 of the finishing head 12 and into the cavity 26 of the tube body 20. Because at least part of the finishing head 12 will have been inserted into the joint compound while filling the cavity 26, the operator may need to clean the bottom face 52*b* of the block portion 52 and the blade 100, if the blade 100 had been in the blade slot 80. In some cases, the operator will elect to skip cleaning the bottom face 52*b* of the block portion 52 prior to continuing. The finishing head 12 is then placed against a joint on the application surface. In this position, the wheels 68 and the blade 100 are preferably against the application surface. Manual pressure is applied by the operator to the double-banded plug 34 through the grip 30 so that compound is extruded from the opening 64. The operator draws the finishing tube assembly 10 along the joint so that the blade 100 travels over the extruded joint compound causing the extruded joint compound to assume the general shape of the bottom edge 108 of the inserted blade 100 on the joint. In general, the blade 100 maintains its nominal shape and does not flex. Therefore, the joint compound applied to the joint will have generally the same shape that is manufactured into the blade 100. However, sometimes the middle section 118 of the blade 100 (or another section depending on the selected blade 100) must travel over elevated areas on the application surface that are significantly higher than the rest of the application surface. In this case, the middle section 118 of the blade 100 is able to float over these elevated areas by flexing upward where the bottom wall 72 of the blade holder 56 provides clearance in the blade slot 80. When the operator completes application of the joint compound to that particular area, the operator may easily remove the current blade 100 and insert a different blade 100 with a different shape or configuration. Alternatively, the operator may remove the blade 100, exposing the blade slot 80 for easy cleaning of the blade slot 80.

FIGS. 10-14 illustrate a finishing tube assembly 210 according to a second embodiment of the disclosure. The finishing tube assembly 210 includes a finishing head 212 that is different than the finishing head 12 according to the first embodiment of the disclosure. The remaining structures (e.g., the compound tube 14, 214) are the same as the finishing tube assembly 10, and therefore only the differences between the finishing tube assembly 10 according to the first embodiment and the finishing tube assembly 210 according to the second embodiment will be discussed below. Similar parts of the finishing tube assembly 210 will include reference numbers that are the same as the finishing tube assembly 10, plus 200.

Figure 11:
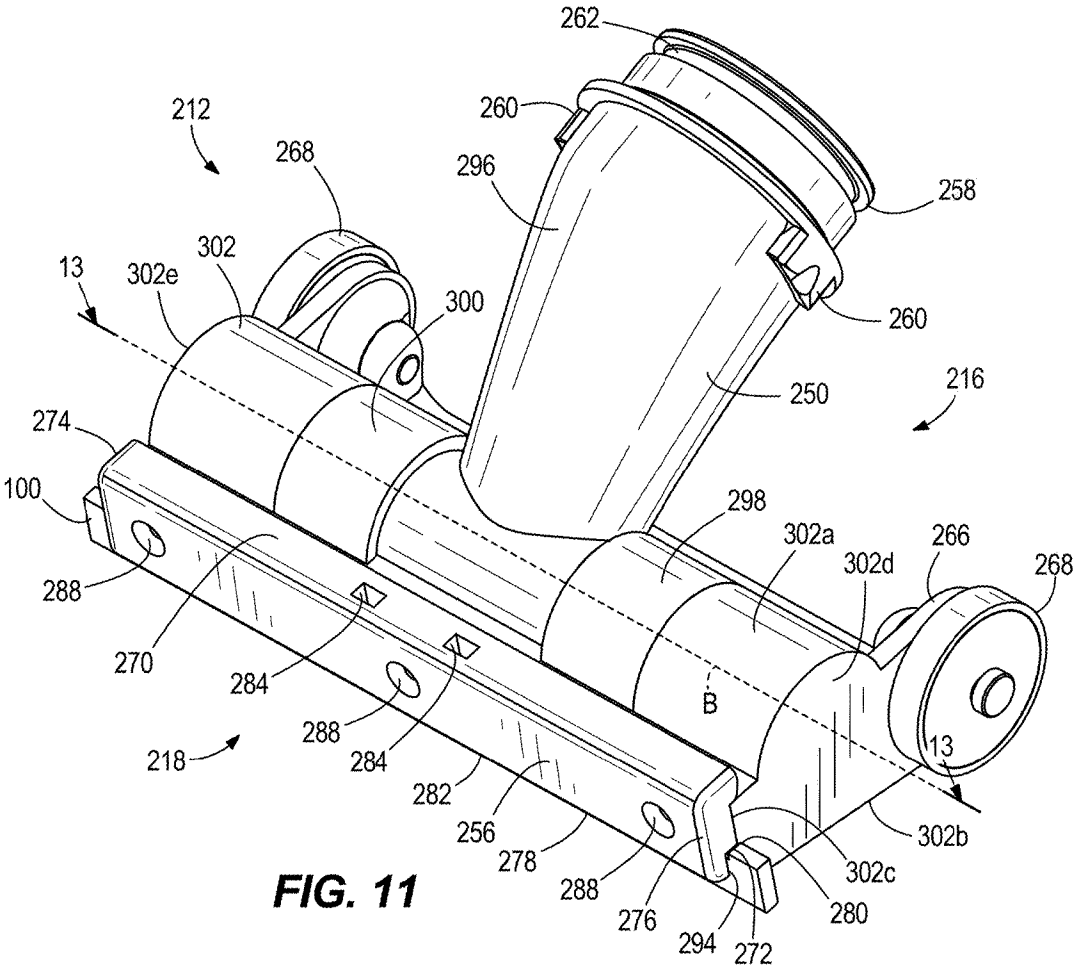
FIG. 11 illustrates a perspective view of a finishing head of the finishing tube assembly of FIG. 10.
Figure 12:
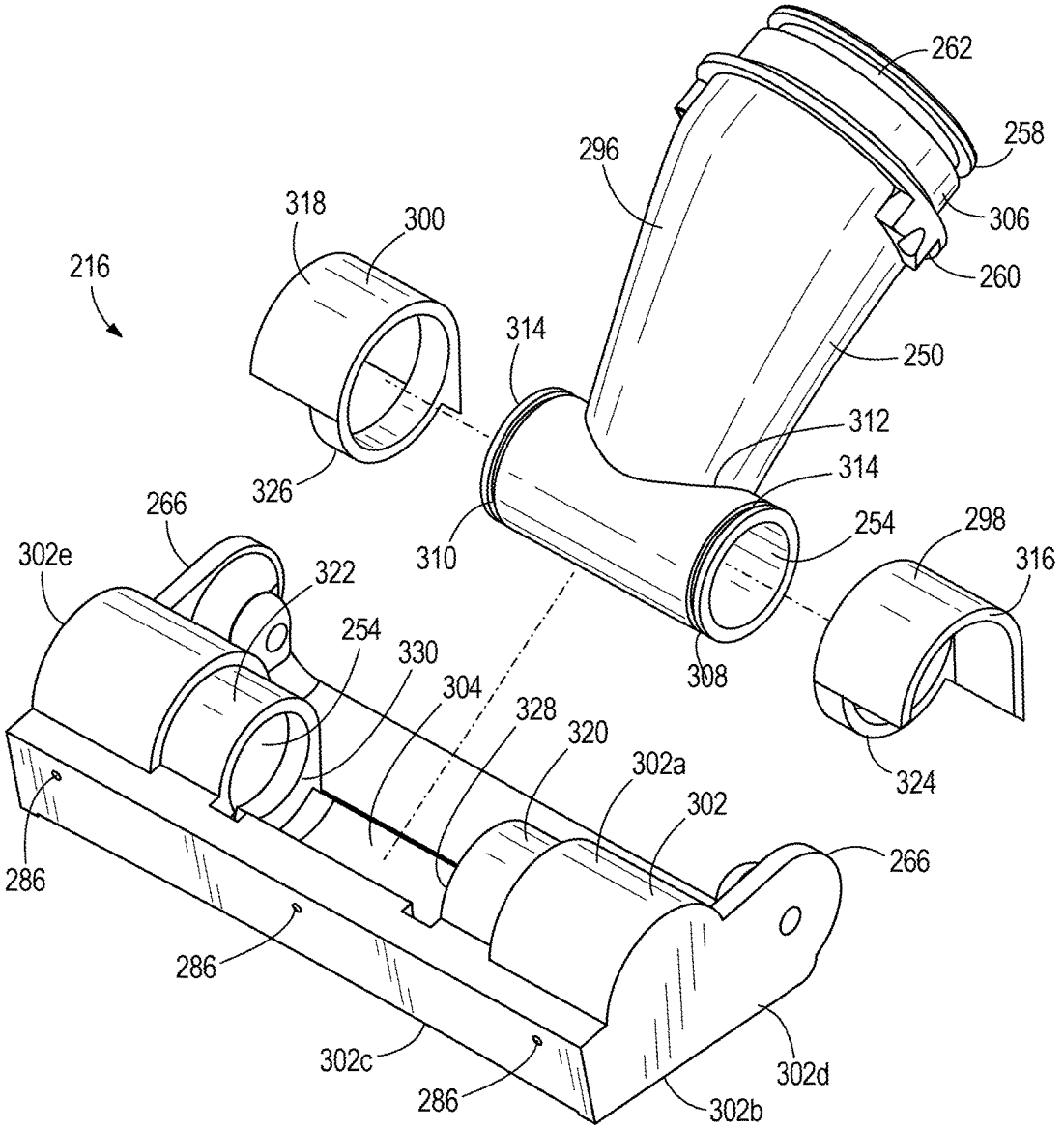
FIG. 12 illustrates a blown-up view of the components of a body of the finishing head of FIG. 11.
Figure 13:
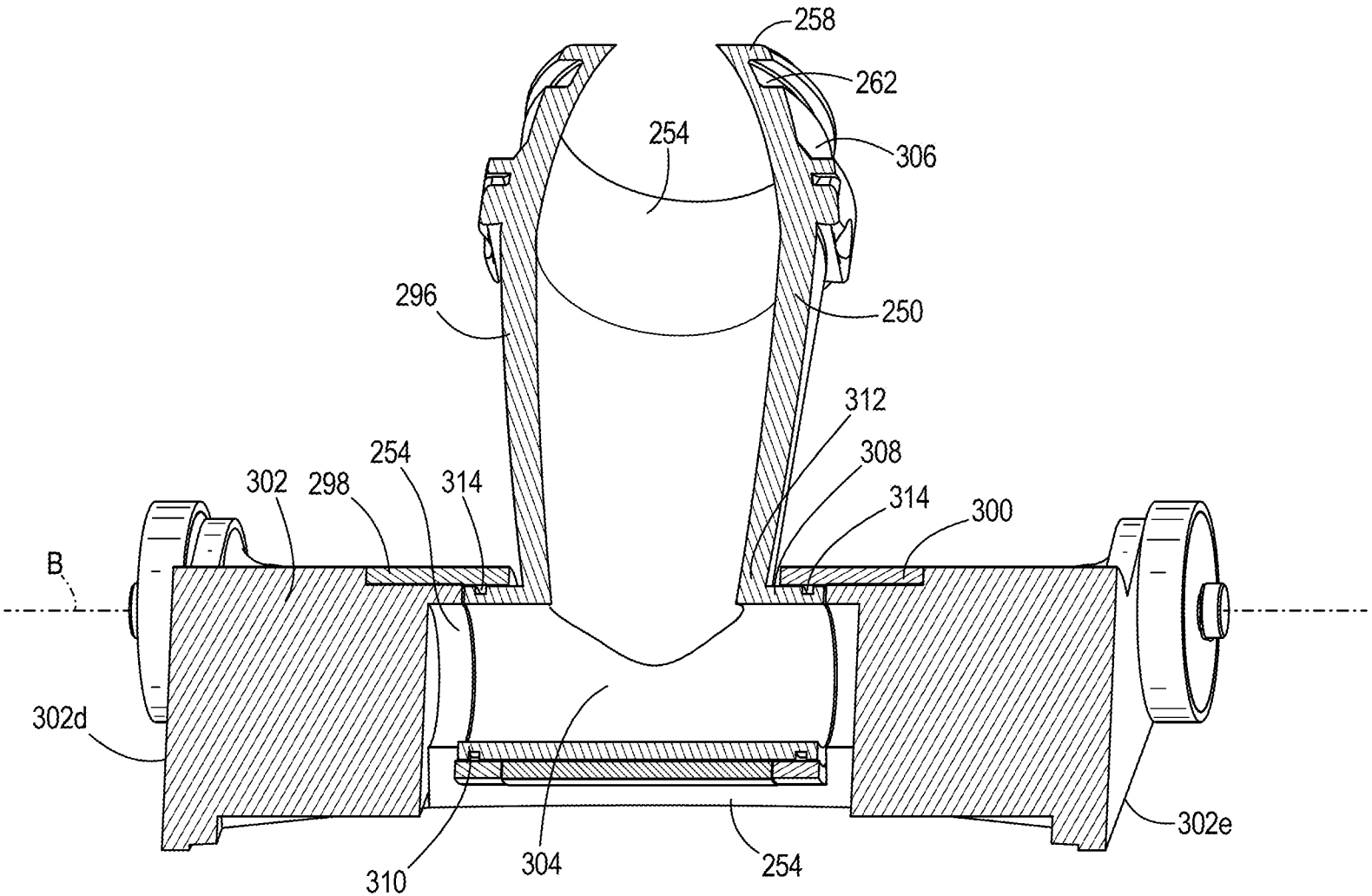
FIG. 13 illustrates a sectional view of the finishing head of FIG. 11 taken from the bottom of rotation axis B.
Figure 14:
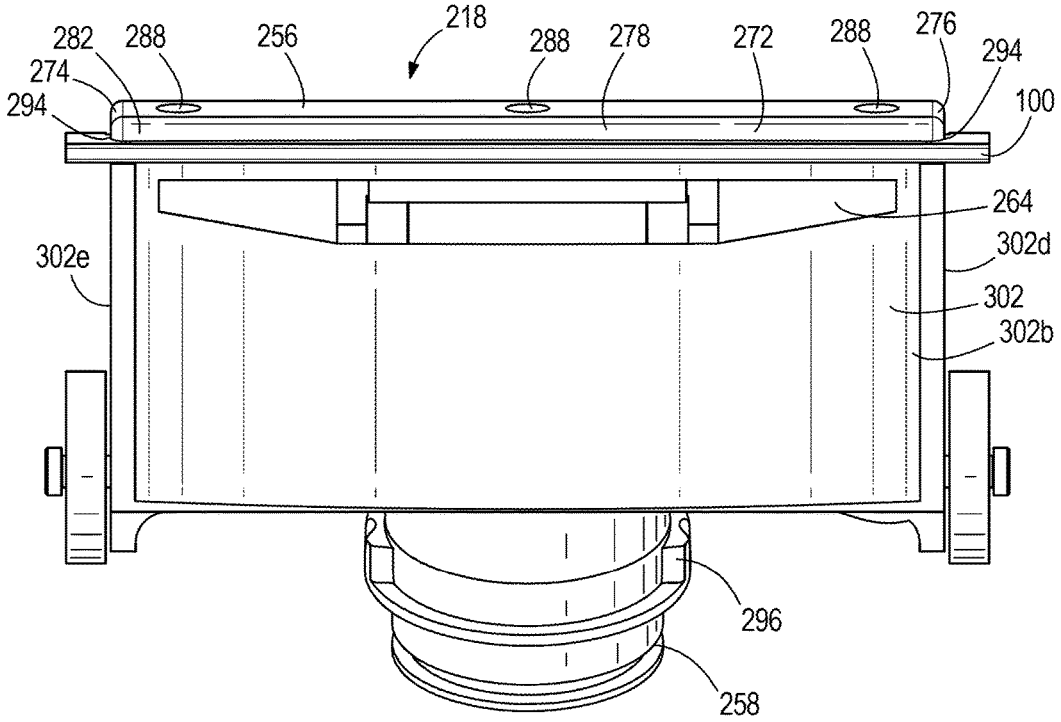
FIG. 14 illustrates a bottom view of the finishing head of FIG. 11.

FIGS. 11 and 12 illustrate that the finishing head 212 includes a head body 216 that is made up of a plurality of parts. The head body 216 includes an adaptor or tube outlet 296, a first cap 298, a second cap 300, and a finisher body or finisher component 302 with a pocket 304 for accepting the tube outlet 296 therein. The tube outlet 296 is generally T-shaped and includes a cylindrical mating portion 258 at a first end 306 of a cone portion 250, where the head body 216 joins the compound tube 214, and a first branch 308 and a second branch 310 at a second end 312 of the cone portion 250. The first branch 308 and the second branch 310 extend from the cone portion 250 at opposing 90 degree angles such that the first branch 308 and the second branch 310 form the T-shape of the tube outlet 296 with the cone portion 250. The first branch 308 and the second branch 310 of the tube outlet 296 are configured to fit within the pocket 304 of the finisher component 302, as illustrated in FIG. 13. The first branch 308 and the second branch 310 each include a seat 314 for an O-ring (not illustrated) to provide a seal between the tube outlet 296 and the first cap 298 and the second cap 300. The first cap 298 is shaped to fit around the first branch 308 and the second cap 300 is shaped to fit around the second branch 310. The second cap 300 is a mirror image of the first cap 298. The first cap 298 and the second cap 300 each include a flap 316, 318 that, when assembled, respectively fit over a first cut-out 320 and a second cut-out 322 of the finisher component 302. The first cap 298 and the second cap 300 each also include a ring portion 324, 326 that, when assembled, respectively fit into a first mating portion 328 and a second mating portion 330 of the finisher component 302. The finisher component 302 is similarly shaped to the block portion 52, described above, and also includes extensions 266 at the end of which wheels 268 and/or skids (not illustrated) may be placed. The finisher component 302 includes a top face 302*a*, a bottom face 302*b* opposing the top face 302*a*, a front face 302*c*, and two side faces 302*d*, 302*e* that oppose each other. As illustrated in FIG. 12, the pocket 304, the first cut-out 320, and the second cut-out 322 are formed in the top face 302*a* of the finisher component 302. As illustrated in FIG. 14, the opening 264 is in the bottom face 302*b* of the finisher component 302 and provides an exit or port for the compound. In the embodiment illustrated in FIG. 14, the opening 264 is not shaped the same as the opening 64 of the first embodiment. The middle section of the opening 264 is wider than the end sections of the opening 264. The wider middle section provides less resistance for flow of the joint compound through the opening 264 so that joint compound is more likely to flow out of the middle section of the opening 264. In other embodiments, the opening 264 may be shaped as described above (e.g., like the opening 64).

The channel 254 of the finishing head 212 extends from the cylindrical mating portion 258 of the tube outlet 296 to the opening 264 in the bottom face 302*b* of the finisher component 302. As illustrated in FIG. 13, a cross section of the channel 254 changes along the length of the cone portion 250 of the head body 216. As illustrated in FIG. 13, joint compound is not capable of flowing in a straight line through the channel 254. Joint compound must flow through one of the first branch 308 and the second branch 310 of the tube outlet 296. The channel 254 continues through one of the first branch 308 and the second branch 310 and into the finisher component 302. The channel 254 extends through the finisher component 302 to the opening 264.

When in use, the finishing head 212 is attached to the compound tube 214 such that a flow path is formed between the cavity 226 of the tube body 220 to the opening 264 of the head body 216, as explained above. The finishing head 212 is rotatable about a rotation axis B that is parallel to a plane of the bottom face 302*b* of the finisher component 302. The longitudinal axis A forms a rotation angle with the plane of the bottom face 302*b* of the finisher component 302. Specifically, the tube outlet 296 rotates about the rotation axis B with respect to the first cap 298, the second cap 300, and the finisher component 302. The tube outlet 296 is rotatable such that, in operation of the finishing tube assembly 210, the rotation angle may be any angle between 5 and 85 degrees. In other embodiments, the rotation angle may be any angle between 0 and 90 degrees. In some embodiments, the finishing head 212 may include a biasing mechanism (not illustrated) to urge the tube outlet 296 to a rotation angle that is preferable for operation of the finishing tube assembly 210. The biasing mechanism may, for example, include a torsion spring (not illustrated) that is positioned along the rotation axis B between the tube outlet 296 and the finisher component 302. The biasing mechanism (not illustrated) may also, for example, include a pair of extension springs (not illustrated) positioned on the exterior of the finishing head 212. The pair of extension springs (not illustrated) may be pulling in opposite directions to allow for rotation about the rotation axis B in both directions, but also urges the tube outlet 296 to the rotation angle that is preferable for operation of the finishing tube assembly 210 if the tube outlet 296 is rotated in either direction about the rotation axis B.

Operation of the finishing tube assembly 210 is similar to the finishing tube assembly 10 of the first embodiment. In operation, the compound tube 214 is rotatably coupleable to the finishing head 212, via the coupling between the compound tube 214 and cylindrical mating portion 258 of the tube outlet 296, so that the bottom face 302*b* of the finisher component 302 may remain flat against the application surface while the rotation angle of the compound tube 214 varies as is most appropriate and comfortable for the operator.

In some cases, a pre-filled tube or bag (not illustrated), for example a caulk-type tube, may be used with the finishing tube assembly 10, 210. For example, the finishing head 12, 212 is removed from the compound tube 14, 214 providing access to the cavity 26, 226 of the tube body 20, 220. As described above, the operator draws back on the grip 30, 230 of the plunger 22, 222 so that the accessible volume of the cavity 26, 226 becomes larger. The operator may then cut an opening, or otherwise open the pre-filled tube or bag, and position the bag in the cavity 26, 226 against the double-banded plug 34, 234 with the opening facing toward the attachment assembly 24, 224. The operator then couples the finishing head 12, 212 to the compound tube 14, 214 via the attachment assembly 24, 224 so that the finishing tube assembly 10, 210 may be used on a joint, as described above. When the pre-filled tube or bag is empty, the operator will remove the finishing head 12, 212 so that the pre-filled tube or bag may be removed. The above-described process may then be repeated as necessary.

FIGS. 15-24 illustrate a finishing tube assembly 410 according to a third embodiment of the disclosure. The finishing tube assembly 410 includes a finishing head 412 and a compound tube 414 that are different than the finishing heads 12, 212 and compound tubes 14, 214, respectively, according to the first and second embodiments of the disclosure. However, the finishing tube assembly 410 is similar to the finishing tube assemblies 10, 210 according to the first and second embodiments such that differences will be described herein. The elements of the finishing tube assembly 410 according to the third embodiment that are similar to a respective element of the finishing tube assembly 210 according to the second embodiment are labeled as the same number plus "200."

Figure 15:
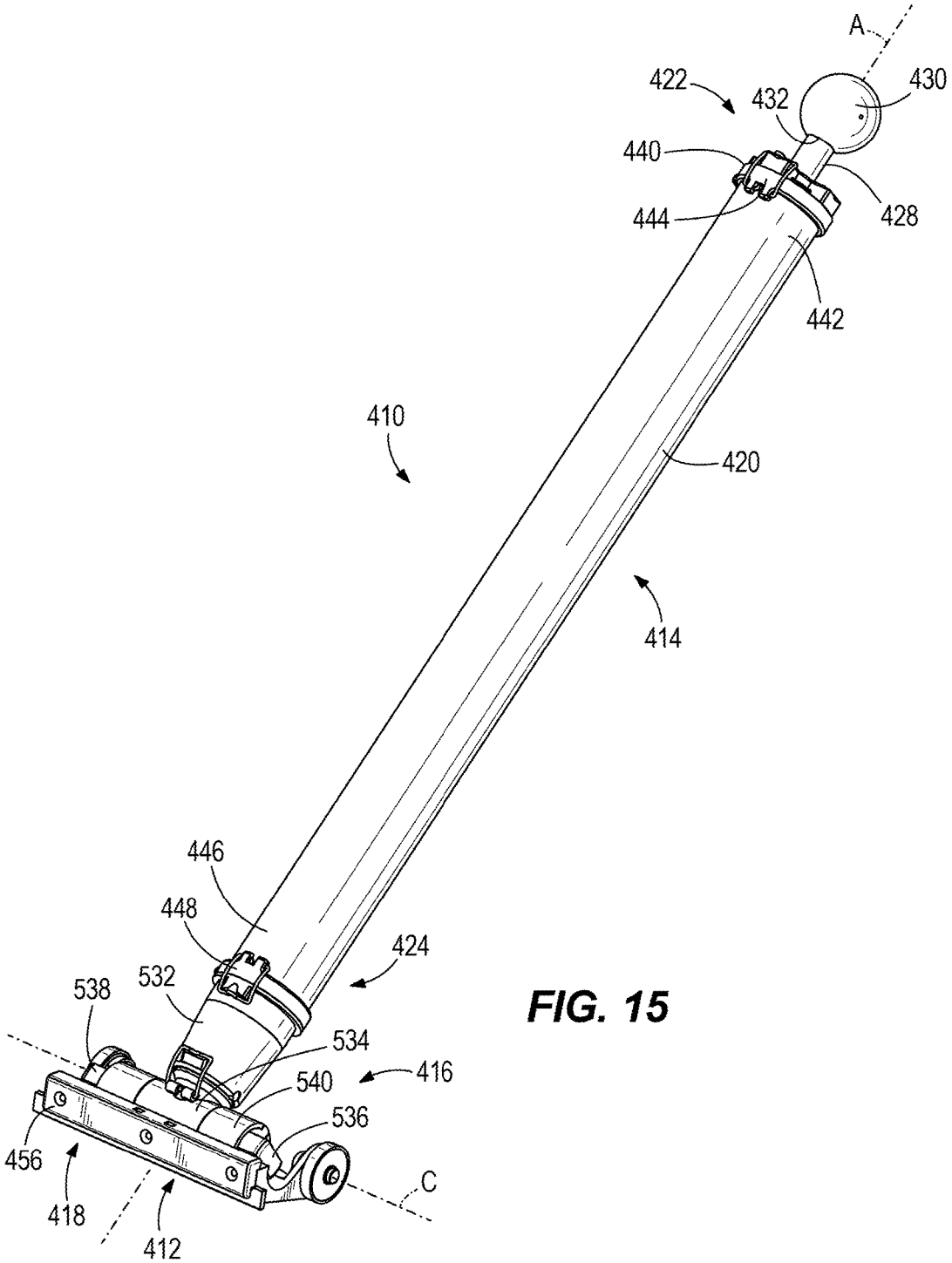
FIG. 15 illustrates a perspective view of a finishing tube assembly according to a third embodiment.

FIG. 15 illustrates that the finishing tube assembly 410 includes a finishing head 412 and a dispenser or compound tube 414. The compound tube 414 is coupled to the finishing head 412 via a tube cap 532, as described in greater detail below.

FIGS. 16-19 illustrate that the finishing head 412 includes a head body 416 that is made up of a plurality of parts. The head body 416 includes an adaptor or tube outlet 534, a first hollow pivot 536, a second hollow pivot 538, and a finisher body or finisher component 540 having a pocket 542 for accepting the tube outlet 534 and at least part of the first and second hollow pivots 536, 538.

Figure 19:
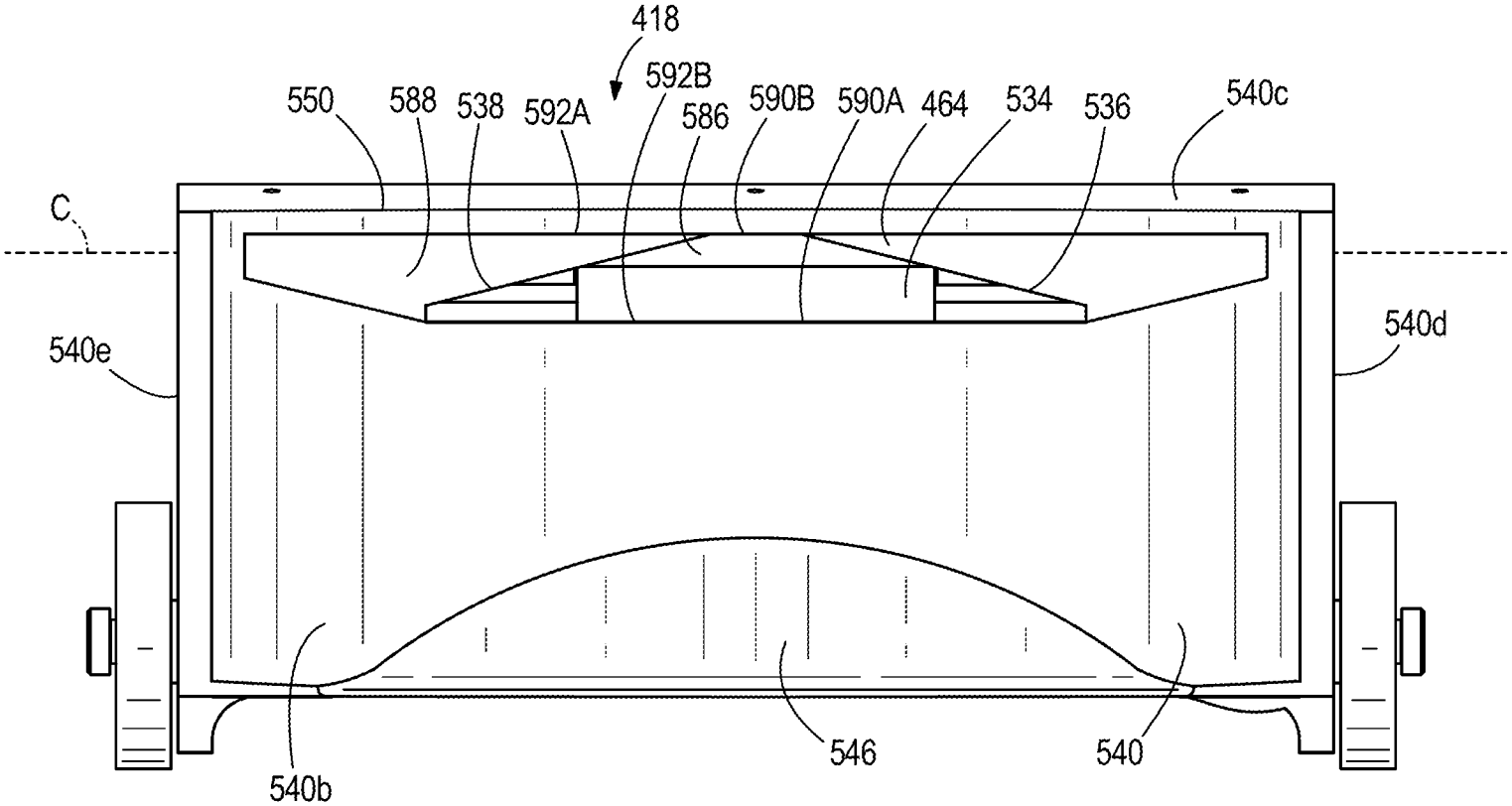
FIG. 19 illustrates a bottom view of the finishing head of FIG. 16.
Figure 20:
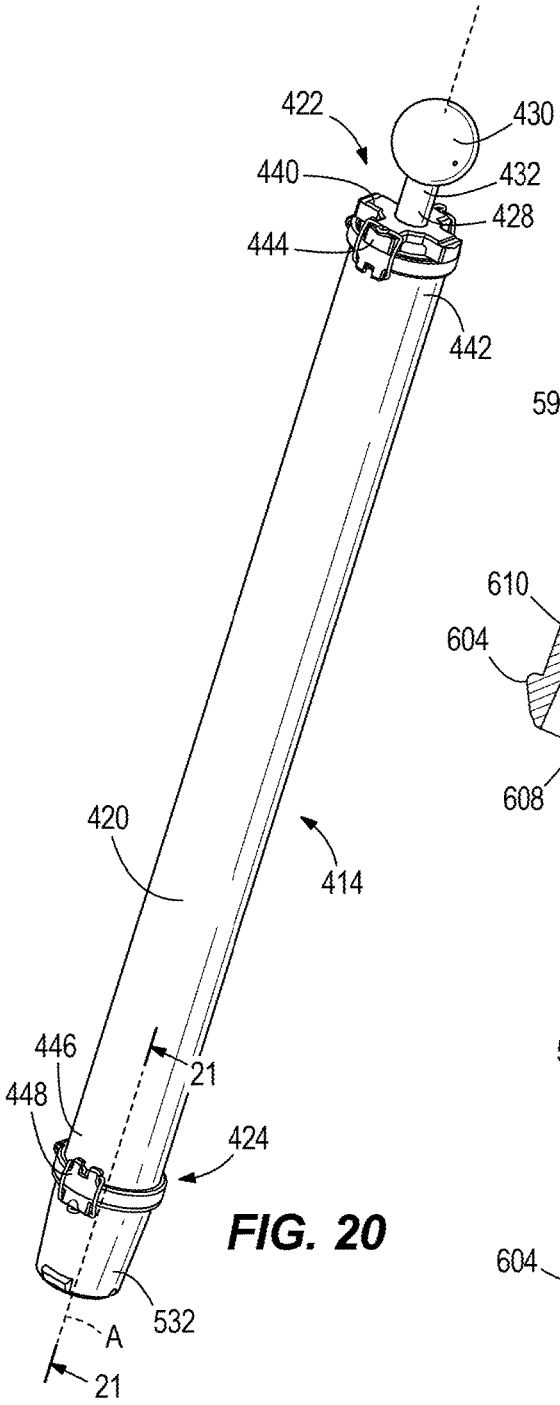
FIG. 20 illustrates a perspective view of a compound tube of the finishing tube assembly of FIG. 15.

The finisher component 540 includes a top face 540*a*, a bottom face 540*b* opposing the top face 540*a*, a front face 540*c*, and two side faces 540*d*, 540*e* that oppose each other. The finisher component 540 also includes two loops 544 on opposite sides of the pocket 542, a raised back end 546, and two wheels 468 that are positioned on opposite sides of the raised back end 546. Each of the two loops 544 includes a notch 548 for locating and securing a respective hollow pivot 536, 538. The back end 546 forms a shape which funnels joint compound toward its center if an operator were to draw the back end 546 over a joint into which too much joint compound was extruded. As illustrated in FIG. 19, the bottom face 540*b* of the finisher component 540 includes an opening 464 that is adjacent a trailing edge 550 of the finisher component 540 (i.e., the bottom edge, relative to FIG. 17, of the front face 540*c*) and that provides an exit or port for the compound to leave the finishing head 412. The front face 540*c* of the finisher component 540 includes fastener openings 486 for coupling the blade holder 456 to the finishing head 412. In the illustrated embodiment, the blade holder 456 is coupled to the finisher component 540 via three fasteners (not illustrated). In other embodiments, any suitable number of fasteners and fastener openings 486 may be used to couple the blade holder 456 to the finisher component 540. In yet other embodiments, the blade holder 456 may be integrally formed as one piece with the finisher component 540 so the blade holder 456 and the finisher component 540 are one-piece.

Figure 17:
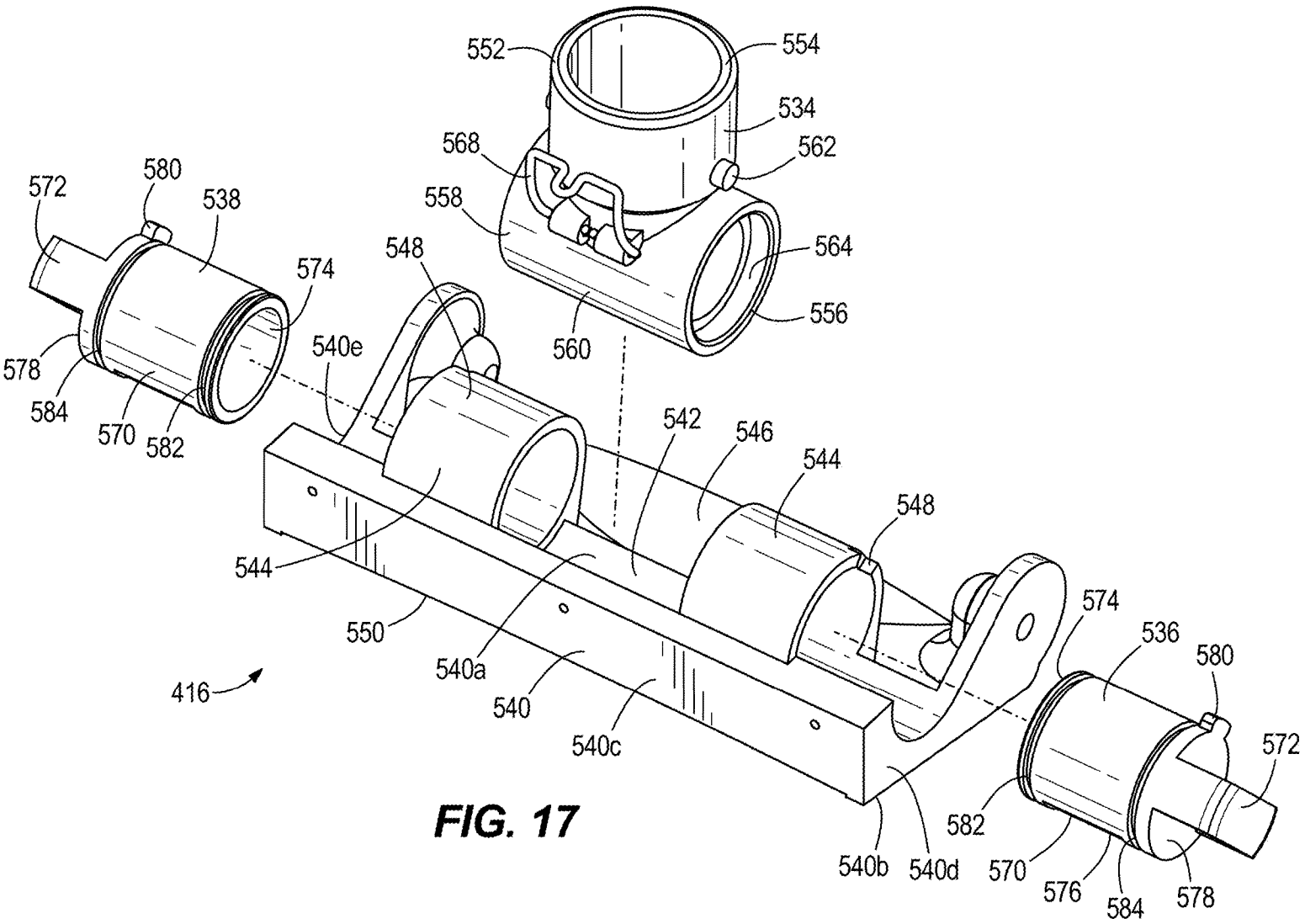
FIG. 17 illustrates a blown-up view of the components of a body of the finishing head of FIG. 16.
Figure 18:
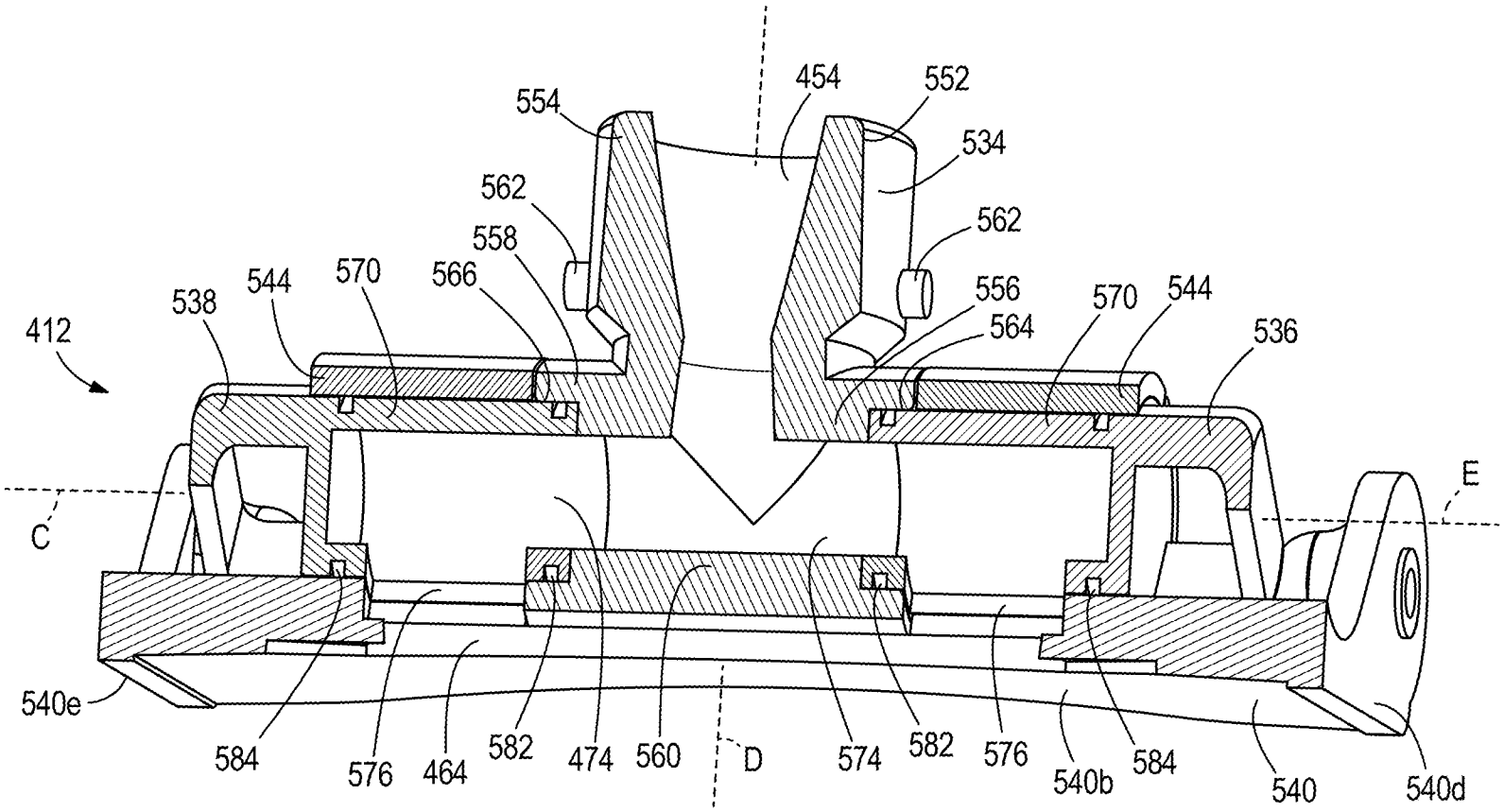
FIG. 18 illustrates a sectional view of the finishing head of FIG. 16 taken from the bottom of rotation axis C.

The tube outlet 534, like the tube outlet 296 according to the second embodiment, is generally T-shaped and hollow. The tube outlet 534 includes a cylindrical mating portion 552 at a first end 554, which defines an inlet and where the head body 416 joins the compound tube 414, and a first and second branch 556, 558, which define outlets, at a second end 560. Two knobs 562 radially extend from the cylindrical mating portion 552. As illustrated by FIG. 17, an inlet axis D, defined by the cylindrical mating portion 552, and an outlet axis E, defined by the first and second branch 556, 558, are perpendicular. The first branch 556 and the second branch 558 extend from the cylindrical mating portion 552 at opposing 90 degree angles and are configured to fit within the pocket 542 of the finisher component 540, as illustrated in FIG. 18. The first branch 556 and the second branch 558 each include an annular depression 564, 566 which respectively house an end of the first hollow pivot 536 and the second hollow pivot 538, as explained in greater detail below. The tube outlet 534 also includes a securing clip 568 which is rotatably coupled to the tube outlet 534 and secures the finishing head 412 to the compound tube 414, as explained in greater detail below. In another embodiment, the securing clip 568 may include a biasing mechanism to influence the securing clip 568 toward the cylindrical mating portion 552 of the tube outlet 534.

The second hollow pivot 538 is a mirror of the first hollow pivot 536. The first hollow pivot 536 and the second hollow pivot 538 each include a generally cylindrical body 570 that is hollow and a pull handle 572 that is attached to the cylindrical body 570. The first and second hollow pivots 536, 538 each include an open axial end 574 and an aperture 576 that extends through the side of the cylindrical body 570, as illustrated in FIG. 18. The pull handle 572 is a U-shaped handle coupled to an end 578 that is opposite the open axial end 574. Each of the first hollow pivot 536 and the second hollow pivot 538 include a tab 580 that radially extends from the cylindrical body 570 at the end 578 adjacent the pull handle 572. The tabs 580 fit within the notches 548 of the two loops 544 of the finisher component 540. Each of the first hollow pivot 536 and the second hollow pivot 538 also include two seats 582, 584 adjacent the ends 574, 578 of the cylindrical body 570 for positioning an O-ring (not illustrated) around the generally cylindrical body 570 to provide liquid tight seals between the components of the finishing head 412.

Figure 16:
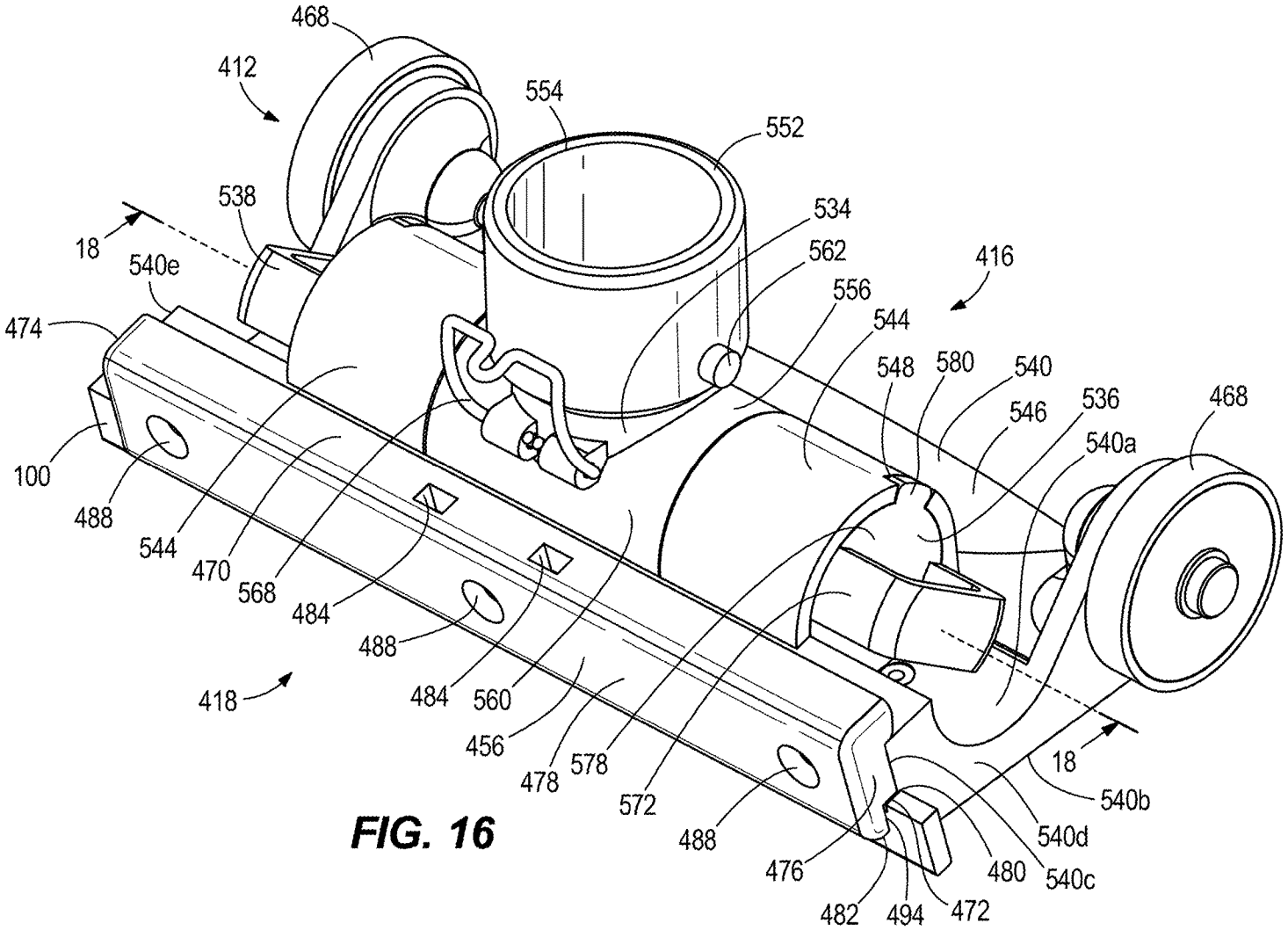
FIG. 16 illustrates a perspective view of a finishing head of the finishing tube assembly of FIG. 15.

To assemble the finishing head 412, the tube outlet 534 is positioned in the pocket 542 of the finisher component 540 and the first and second hollow pivots 536, 538 are inserted through a respective loop 544 such that the end 574 of the first hollow pivot 536 and the end 574 538 extend into the annular depression 564 of the first branch 556 and the annular depression 566 of the second branch 558, respectively, as illustrated in FIG. 18. As illustrated in FIG. 16, the hollow pivots 536, 538 are each inserted such that the tabs 580 fit into the notches 548 of the loops 544. The pull handles 572 of the first and second hollow pivots 536, 538 allows an operator to pull the hollow pivots 536, 538 from the assembled position to quickly and simply disassemble the finishing head 412, for example to clean the finishing head 412. Similar to the second embodiment described above, the tube outlet 534 is pivotable about a pivot axis C relative to the finisher component 540 and the first and second hollow pivots 536, 538. The abutment between the tabs 580 of the hollow pivots 536, 538 and the notches 548 of the loops 544 of the finisher component 540 prevents the hollow pivots 536 from significant rotation relative to the finisher component 540.

In the assembled state, the finishing head 412 provides a channel 454 for joint compound that extends from the cylindrical mating portion 552 of the tube outlet 534 to the opening 464 on the bottom face 540*b* of the finisher component 540. As illustrated in FIG. 18, a cross section of the channel 454 changes along the length of the finisher component 540. In the illustrated embodiment of FIG. 18, the channel 454 narrows from the first end 554 to the second end 560 of the tube outlet 534. As illustrated in FIG. 18, joint compound is not capable of flowing in a straight line through the channel 454 to the opening 464 and must flow through one of the first branch 556 and the second branch 558 of the tube outlet 534.

First, joint compound flows into the channel 454 at the cylindrical mating portion 552 from the compound tube 414. The joint compound then flows through one of the first and second branch 556, 558 of the tube outlet 534 and into a respective one of the first hollow pivot 536 and the second hollow pivot 538 through the open axial end 574. The joint compound continues through the hollow pivot 536, 538 and into the finisher component 540 via the aperture 576 in the side of the hollow pivot 536, 538. Because more joint compound is needed in the center of the joint as opposed to the edges, joint compound is funneled toward the center of the opening 464 by the shape of the opening 464. As illustrated in FIGS. 18-19, the opening 464 is provided by two trapezoids 586, 588. The two parallel edges 590A, 590B, 592A, 592B of each trapezoid 586, 588 are parallel with the trailing edge 550 of the finisher component 540. The first trapezoid 586, which directly communicates with the apertures 576 of the hollow pivots 536, 538, is oriented such that the larger of the two parallel edges 590A is farther from the trailing edge 550 than the smaller of the two parallel edges 590B. The second trapezoid 588 is arranged opposite to the first trapezoid 586, i.e., the smaller of the two parallel edges 592B is farther from the trailing edge 550 than the larger of the two parallel edges 592A. Like the opening 264 according to the second embodiment, the wider middle section of the opening 464 provides less resistance for flow of the joint compound out of the finishing head 412. In other embodiments, the opening 464 may be shaped as described above (e.g., like the opening 64, 264 according to the first or second embodiment).

FIGS. 15 and 20-24 illustrate the compound tube 414 according to the third embodiment of the finishing tube assembly 410. Similar to the compound tube 14, 214 described above, the compound tube 414 includes the tube body 420, the plunger 422, and the head attachment assembly 424. Unlike the compound tube 14, 214 described above, the head attachment assembly 424 further includes a tube cap 532.

Figure 21:
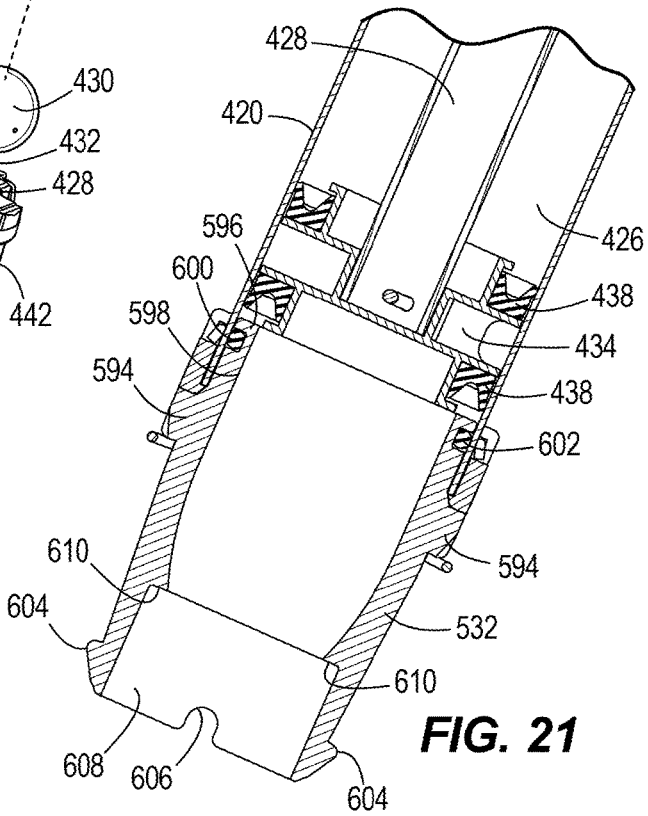
FIG. 21 illustrates a partial, sectional view of the compound tube of FIG. 20.
Figure 22:
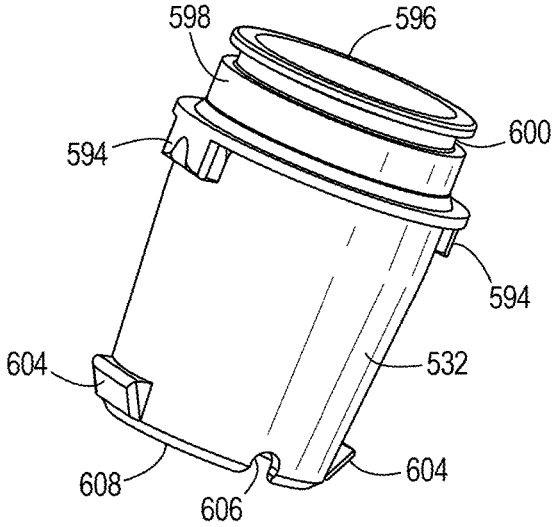
FIG. 22 illustrates a perspective view of a tube cap of the compound tube of FIG. 20.
Figure 23:
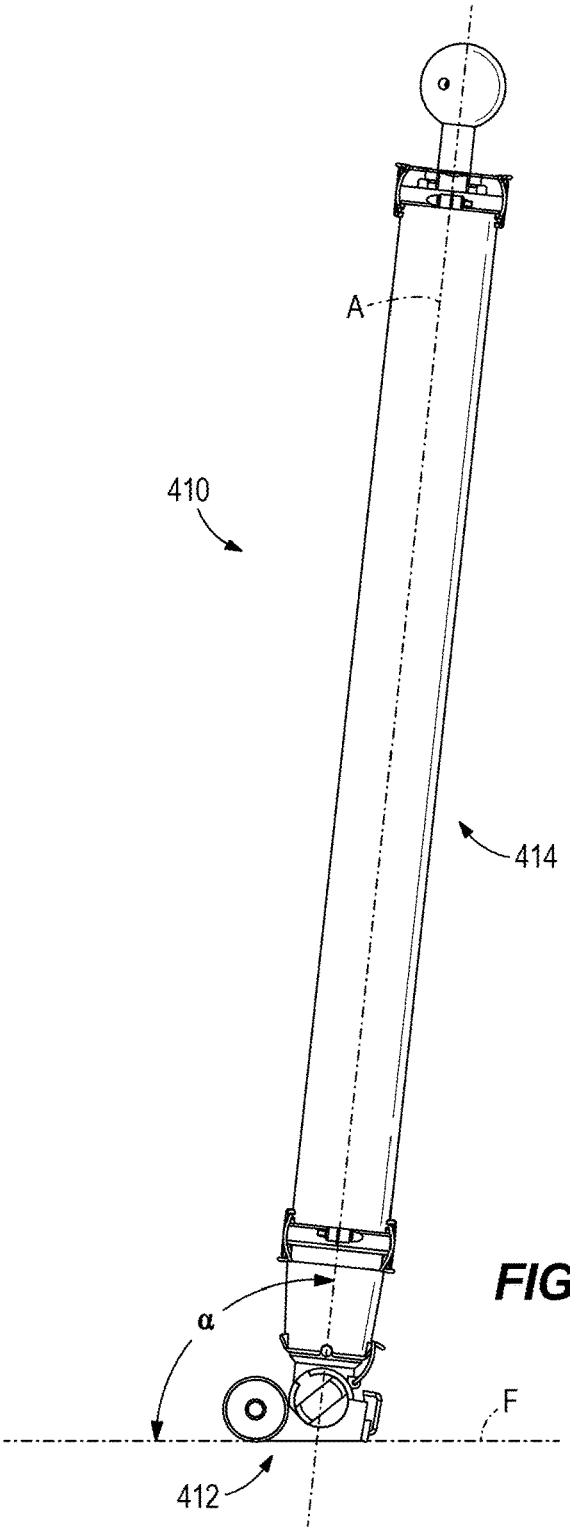
FIG. 23 illustrates a side view of the finishing tube assembly according to the third embodiment.
Figure 24:
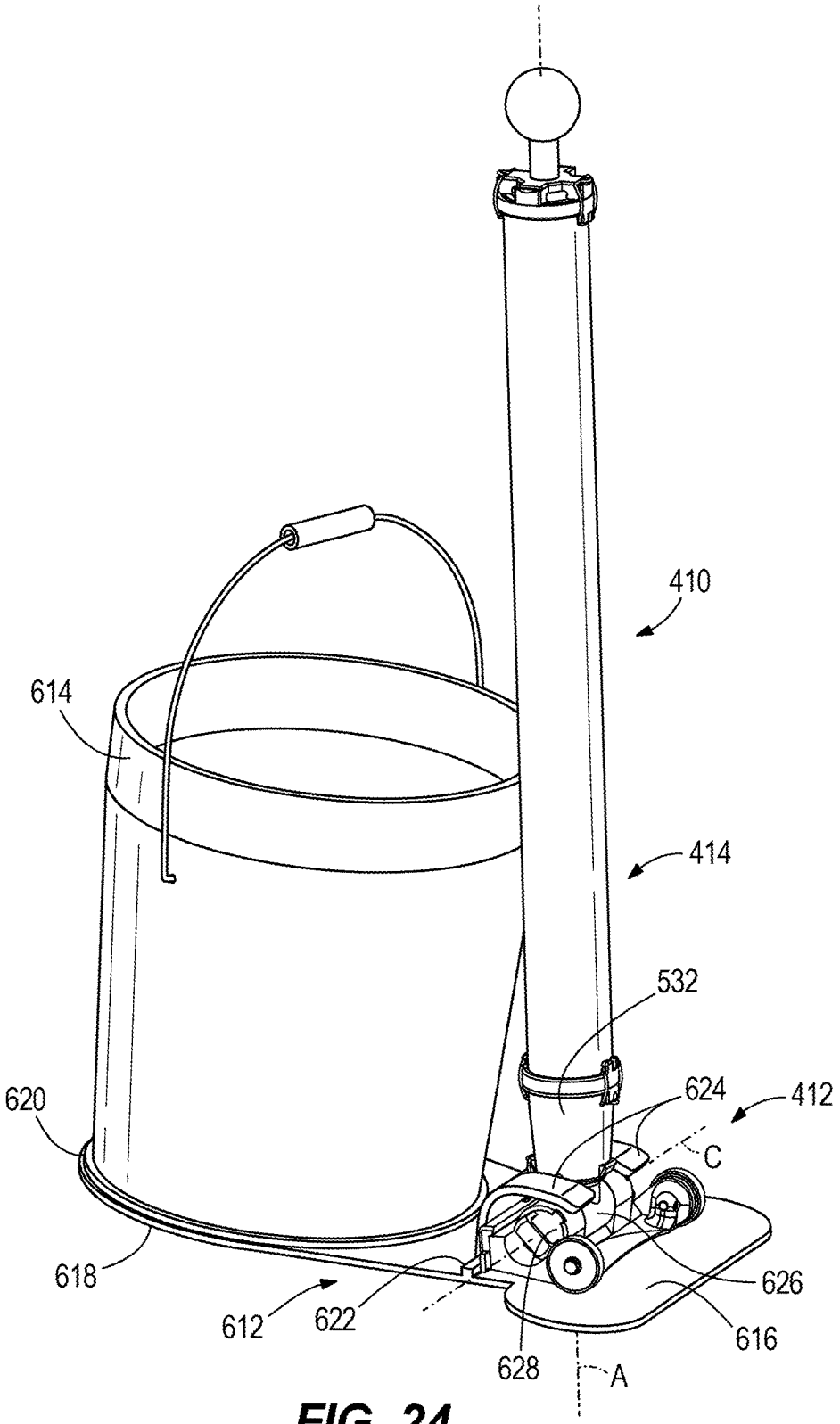
FIG. 24 illustrates a perspective view of a caddy being used with a bucket and the finishing tube assembly of FIG. 15.

As illustrated in FIGS. 21 and 22, the tube cap 532 includes two extensions 594 that couple to the two clips 448 of the head attachment assembly 424 and that are adjacent a first end 596 of the tube cap 532. A segment 598 at the first end 596 of the tube cap 532 extends into the cavity 426 of the tube body 420 such that the end of the segment 598 provides a limit for the double-banded plug 434, as illustrated in FIG. 21. The segment 598 includes a seat 600 for an O-ring 602 to provide a seal between an exterior of the tube cap 532 and an interior of the tube body 420. The tube cap 532 also includes two radially extending fingers 604 and two depressions 606 for coupling to the finishing head 412 at a second end 608 of the tube cap 532. The two depressions 606 may be used to locate the compound tube 414 relative to the finishing head 412. Specifically, the second end 608 of the tube cap 532 is placed around the tube outlet 534 and the two depressions 606 respectively fit about the two knobs 562 of the cylindrical mating portion 552 of the tube outlet 534 such that when the compound tube 414 is correctly located on the finishing head 412, the securing clip 568 may be rotated about one of the radially extending fingers 604 to couple the finishing head 412 to the compound tube 414, as illustrated in FIGS. 15, 23, and 24. The securing clip 568 fits about either of the two fingers 604. In some embodiments, the securing clip 568 may be unnecessary as the tube outlet 534 frictionally couples to an interior of the tube cap 532. In the illustrated embodiment of FIG. 21, the interior of the tube cap 532 includes a radially extending seat 610 provided for the tube outlet 534. In other embodiments, the cylindrical mating portion 552 of the tube outlet 534 does not reach the seat 610.

FIG. 24 illustrates a caddy 612 to be used with the third embodiment of the finishing tube assembly 410 and a bucket 614 filled with joint compound, as explained in greater detail below. The caddy 612 includes a first section 618 for the bucket 614 to be positioned and supported thereon and a second section 616 to be used with the finishing tube assembly 410. In the illustrated embodiment of FIG. 24, the first section 618 includes a circular raised lip 620 to locate the bucket 614 so that the bucket 614 is not accidentally moved during operation. The second section 616 may be separated from the first section 618 by a holder 622 having two curled claws 624 spaced by a gap 626. The holder 622 may act as an anchor to which the finishing head 412 may be retained while the compound tube 414 is removed from the finishing head 412 to refill the compound tube 414. The finishing tube assembly 410, specifically the finishing head 412, may be wheeled or otherwise positioned into an area 628 underneath the curled claws 624 such that the curled claws 624 hook about the finishing head 412 on opposite sides of the compound tube 414, which extends through the gap 626 between the two curled claws 624.

When fully assembled, the finishing head 412 is attached to the compound tube 414 such that a flow path is formed between the cavity 426 of the tube body 420 to the opening 464 of the finisher component 540. The finisher component 540 is rotatable about the pivot axis C relative to the tube outlet 534 and the compound tube 414. As illustrated by FIG. 23, the longitudinal axis A forms a rotation angle $\alpha$ with an axis F that is defined by the bottom face 540*b* of the finisher component and is perpendicular to the pivot axis C. The finisher component 540 is rotatable such that the rotation angle $\alpha$ may be between 5 and 100 degrees in the illustrated embodiment. In other embodiments, the rotation angle $\alpha$ may be between 0 and 135 degrees. In some embodiments, the finishing head 412 and/or the compound tube 414 may include a biasing mechanism (not illustrated) to urge the finisher component 540 to a rotation angle $\alpha$ that is preferable for operation of the finishing tube assembly 410. The biasing mechanism may, for example, include a torsion spring (not illustrated) that is positioned along the pivot axis C between the tube outlet 534 and the finisher component 540. The biasing mechanism may also, for example, include a pair of extension springs (not illustrated) positioned on the exterior of the finishing head 212. The pair of extension springs may be pulling in opposite directions to allow for rotation about the pivot axis C in both directions, but also urges the finisher component 540 to the rotation angle $\alpha$ that is preferable for operation of the finishing tube assembly 410 if the compound tube 414 is rotated in either direction about the pivot axis C.

In operation, the finishing tube assembly 410 may be fully assembled, as described above, and the finishing head 412 may be positioned beneath the curled claws 624 such that the compound tube 414 may extend through the gap 626 and may be rested upon the holder 622. An operator may bend down and unlatch the securing clip 568 from one of the fingers 604 so the compound tube 414 may be separated from the finishing head 412 by pulling the compound tube 414 away from the finishing head 412. The finishing head 412 will abut the curled claws 624, keeping the finishing head 412 in the area 628 beneath the claws 624. The cavity 426 is filled with joint compound by inserting the tube cap 532 into the bucket 614 and pulling back on the grip 430 of the plunger 422 (i.e., away from the tube cap 532). The double-banded plug 434 will follow the grip 430 and slide from the second end 446 of the tube body 420 toward the first end 442 of the tube body 420 and therefore draw joint compound through the tube cap 532 and into the cavity 426 of the tube body 420. Because the finishing head 12 will not have been inserted into the joint compound while filling the cavity 426, the operator will not need to clean the finisher component 540 or the blade 100. In some cases, the operator may clean the tube cap 532 prior to continuing. The tube cap 532 is then positioned about the cylindrical mating portion 552 of the tube outlet 534 with the depressions 606 of the tube cap 532 positioned about the knobs 562. The securing clip 568 is then rotated about the finger 604 to securely couple the finishing head 412 to the compound tube 414. As stated above, in some embodiments, the operator may not need to rotate the clip 568 about the finger 604. The finishing tube assembly 410 is pulled from the caddy 612 and the finishing head 412 is placed against a joint of an application surface. In this position, the wheels 468 and the blade 100 are preferably against the application surface. Manual pressure is applied by the operator to the double-banded plug 434 through the grip 430 so that joint compound is extruded from the opening 464. The operator draws the finishing tube assembly 10 along the joint so that the blade 100 travels over the extruded joint compound causing the extruded joint compound to assume the general shape of the bottom edge 108 of the inserted blade 100 on the joint. The compound tube 414 is rotatably coupled to the finisher component 540 so that the bottom face 540*b* of the finisher component 540 may stay flat against the application surface while maintaining a comfortable grip for the operator. The rotation angle $\alpha$ varies as is most appropriate and comfortable for the operator. In general, the blade 100 maintains its nominal shape and does not flex. Therefore, the joint compound applied to the joint will have generally the same shape that is manufactured into the blade 100. When the operator completes application of the joint compound to that particular area, the operator may easily remove the current blade 100 and insert a different blade 100 with a different shape or configuration. Alternatively, the operator may remove the blade 100, exposing the blade slot 80 for easy cleaning of the blade slot 80. In some cases, the operator may continue to a new joint. If the operator uses all of the joint compound in the cavity 426, the operator may position the finishing tube assembly 410 in the caddy 612, as described above, and the above process may be repeated as necessary.

Various features and advantages of the disclosure are set forth in the following claims.

What is claimed is:

1. A finishing head for attachment to a viscous material dispenser, the finishing head comprising:

an adapter including an inlet attachable to the viscous material dispenser and defining a first axis, and an outlet defining a second axis perpendicular to the first axis;

a finisher body including a cavity and an opening in a bottom face thereof; and a hollow pivot pivotably coupling the adapter to the finisher body about the second axis, wherein the cavity of the finisher body is in fluid communication with the adapter outlet via the hollow pivot such that viscous material discharged from the adapter outlet passes through the hollow pivot before being discharged from the opening of the finisher body.

2. The finishing head according to claim 1, wherein the hollow pivot is a first hollow pivot, wherein the finishing head further comprises a second hollow pivot pivotably coupling the adapter to the finisher body about the second axis, and wherein the cavity of the finisher body is in fluid communication with the adapter outlet via the first hollow pivot and the second hollow pivot such that the viscous material discharged from the adapter outlet passes through one of the first hollow pivot or the second hollow pivot before being discharged from the opening of the finisher body.

3. The finishing head according to claim 2, wherein the finisher body includes two loops and the cavity is at least partially defined between the two loops, and wherein the first hollow pivot extends through one of the two loops and the second hollow pivot extends through the other one of the two loops to pivotably couple the adapter to the finisher body and hold the adapter in the cavity between the two loops.

4. The finishing head according to claim 3, wherein the adapter is T-shaped and includes a first branch and a second branch collectively defining the outlet of the adapter, wherein the first hollow pivot extends into the first branch, and wherein the second hollow pivot extends into the second branch.

5. The finishing head according to claim 3, wherein the first hollow pivot and the second hollow pivot each include a radially extending tab, wherein the two loops each include a depression such that when the first hollow pivot extends through the one of the two loops, the radially extending tab of the first hollow pivot is positioned within the depression of the one of the two loops and when the second hollow pivot extends through the other one of the two loops, the radially extending tab of the second hollow pivot is positioned within the depression of the other one of the two loops.

6. The finishing head according to claim 1, further comprising a blade assembly coupled to the finisher body.

7. The finishing head according to claim 6, wherein the blade assembly includes a blade holder projecting from a front end of the finisher body and a removable blade at least partially received in a blade slot defined between the blade holder and the finisher body.

8. The finishing head according to claim 7, wherein the blade slot holds the removable blade therein by frictional engagement between the blade holder and the finisher body.

9. The finishing head according to claim 1, wherein the opening includes a middle section that is wider than opposite ends of the opening, and wherein the opening is configured to funnel the viscous material toward the middle section.

10. The finishing head according to claim 1, wherein the adapter includes a securing clip for removably coupling the finishing head to the viscous material dispenser.

* * * * *